US012410602B2

(12) United States Patent
Meagher et al.

(10) Patent No.: US 12,410,602 B2
(45) Date of Patent: Sep. 9, 2025

(54) METHOD AND ARRANGEMENT FOR CONSTRUCTING AND INTERCONNECTING PREFABRICATED BUILDING MODULES

(71) Applicant: Onx, Inc., Carrollton, TX (US)

(72) Inventors: Patrick Meagher, Denton, TX (US); Nejeebkhan Rayamarakkar, Austin, TX (US); Nic Brathwaite, Danville, CA (US)

(73) Assignee: Onx, Inc., Georgetown, TX (US)

( * ) Notice: Subject to any disclaimer, the term of this patent is extended or adjusted under 35 U.S.C. 154(b) by 0 days.

(21) Appl. No.: 18/233,140

(22) Filed: Aug. 11, 2023

(65) Prior Publication Data

US 2023/0383517 A1 Nov. 30, 2023

Related U.S. Application Data

(62) Division of application No. 17/678,635, filed on Feb. 23, 2022, now Pat. No. 11,795,680.

(Continued)

(51) Int. Cl.

| | |
|---|---|
| ***E04B 1/14*** | (2006.01) |
| ***E04B 1/41*** | (2006.01) |
| ***E04B 1/74*** | (2006.01) |

(52) U.S. Cl.

CPC ..... *E04B 1/14* (2013.01); *E04B 1/4157* (2013.01); *E04B 1/74* (2013.01); *E04B 2001/742* (2013.01)

(58) Field of Classification Search

CPC . E04B 1/14; E04B 1/74; E04B 1/4157; E04B 2001/742

(Continued)

(56) References Cited

U.S. PATENT DOCUMENTS

| | | | |
|---|---|---|---|
| 3,055,694 | A | 9/1962 | Billner |
| 3,265,826 | A | 8/1966 | Autry et al. |

(Continued)

FOREIGN PATENT DOCUMENTS

| | | | |
|---|---|---|---|
| CN | 1506420 | A | 6/2004 |
| CN | 102173709 | A | 9/2011 |

(Continued)

OTHER PUBLICATIONS

"4 Elements of Soundproofing", www.soundproofingcompany.com, 10 pages.

(Continued)

*Primary Examiner* — James J Buckle, Jr.

(74) *Attorney, Agent, or Firm* — Haverstock & Owens, A Law Corporation

(57) ABSTRACT

A modular building system allows for quickly and easily erecting prefabricated wall panels on a building foundation at a construction site. The system allows for manufacturing and installing, at a high level, complete budding components, using steps that are highly repeatable and scalable, resulting in construction that is quick and efficient, and easily performed at many types and locations of construction sites. A system in accordance with the invention comprises a wall panel, a floor panel and a roof panel. The wall panel comprises a horizontal member supported along a bottom horizontal edge, and a plurality of vertical studs integral to the horizontal member and extending vertically downward from the horizontal member. A floor panel comprises a rail disposed rigidly fixed to the foundation and defining an enclosure to receive the plurality of vertical studs of the wall panel to thereby vertically position the wall panel upon the foundation.

11 Claims, 15 Drawing Sheets

Related U.S. Application Data

(60) Provisional application No. 63/152,793, filed on Feb. 23, 2021.

(58) Field of Classification Search
USPC ..... 52/481.2
See application file for complete search history.

(56) References Cited

U.S. PATENT DOCUMENTS 3,313,073 A 4/1967 Mathews
3,460,281 A 8/1969 Levy
3,703,058 A 11/1972 Klett et al.
3,765,543 A 10/1973 Thomas
3,797,257 A 3/1974 Long
3,974,607 A 8/1976 Balinki
3,992,839 A 11/1976 LaBorde
4,285,184 A 8/1981 Turner, Jr.
4,296,048 A 10/1981 Sim et al.
4,616,453 A * 10/1986 Sheppard, Jr. ..... E04C 3/40 52/693
4,862,660 A 9/1989 Raymond
5,024,030 A 6/1991 Morrison
5,040,345 A 8/1991 Gilmour
5,313,752 A 5/1994 Hatzinikolas
5,353,560 A * 10/1994 Heydon ..... E04B 7/22 52/592.1
5,440,845 A 8/1995 Tadros et al.
5,505,031 A * 4/1996 Heydon ..... E04B 1/7654 52/800.1
5,559,311 A 9/1996 Gorbatoff
5,588,268 A 12/1996 Sterflinger
5,685,113 A 11/1997 Reuter
5,689,922 A 11/1997 Daudet
5,706,620 A 1/1998 DeZen
5,715,642 A * 2/1998 Buers ..... E04C 3/11 52/656.1
5,746,544 A 5/1998 Baghoomian
5,746,822 A 5/1998 Espinoza et al.
5,996,296 A 12/1999 Bisbee
6,015,026 A 1/2000 McGrath
6,118,676 A 9/2000 Divan
6,122,867 A 9/2000 Leconte
6,131,350 A 10/2000 Sanders
6,189,269 B1 2/2001 DeZen
6,202,381 B1 3/2001 Dame
6,256,960 B1 7/2001 Babcock et al.
6,295,764 B1 10/2001 Berridge
6,295,778 B1 10/2001 Burt
6,371,637 B1 4/2002 Atchinson
6,426,632 B1 7/2002 Clunn
6,430,881 B1 8/2002 Daudet
6,647,691 B2 11/2003 Becker
6,658,808 B1 12/2003 Doherty
7,197,853 B1 4/2007 Little, Jr.
7,395,999 B2 7/2008 Walpole
7,596,924 B2 10/2009 Sakae
7,614,199 B2 11/2009 Smalley, III
7,665,257 B2 2/2010 Posey
7,677,009 B2 3/2010 Bowman
7,703,248 B2 4/2010 Dincel
7,716,899 B2 * 5/2010 Beck ..... E04B 5/10 52/92.1
7,752,817 B2 7/2010 Pilz
8,046,962 B2 11/2011 Glick
8,091,316 B2 * 1/2012 Beck ..... E04B 5/10 52/289
8,347,560 B2 1/2013 Gyory
8,413,394 B2 4/2013 Pilz
8,424,251 B1 4/2013 Tinianov
8,505,253 B1 * 8/2013 Medford ..... E04H 9/14 52/302.1
8,555,566 B2 10/2013 Pilz
8,631,616 B2 1/2014 Carrion et al.
8,677,713 B1 3/2014 Sheehy
8,808,863 B2 8/2014 Russell
9,007,745 B1 4/2015 Flegel
9,133,588 B2 9/2015 Stroyer
9,175,470 B2 11/2015 Yin et al.
9,371,650 B2 6/2016 Linares, III
9,499,975 B2 11/2016 Thomas et al.
9,627,863 B1 4/2017 Harrison
9,765,521 B1 9/2017 Abbas et al.
10,041,243 B2 8/2018 Walker
10,227,785 B2 3/2019 McCaffrey
10,619,347 B2 4/2020 Pilz
D888,286 S 6/2020 Spear
10,752,551 B2 8/2020 Wilde
10,961,710 B2 3/2021 Collins et al.
11,035,114 B2 6/2021 Ilda, III
11,174,632 B2 11/2021 Rosan
11,313,121 B2 4/2022 Quinjins
11,560,712 B2 1/2023 Pilz
2001/0023792 A1 9/2001 Noselli
2002/0020120 A1 2/2002 McKenzie
2003/0084629 A1 5/2003 Strickland et al.
2003/0167715 A1 9/2003 Messenger et al.
2003/0196401 A1 10/2003 Surowiecki
2004/0007981 A1 1/2004 Shibata
2004/0065030 A1 4/2004 Zambelli et al.
2006/0257210 A1 11/2006 Williams
2007/0056245 A1 3/2007 Edmondson
2008/0053016 A1 3/2008 Kang
2008/0181729 A1 7/2008 Van Horn
2008/0229696 A1 9/2008 Benson
2009/0051557 A1 2/2009 Beatty
2009/0056253 A1 3/2009 Davis
2010/0058686 A1 3/2010 Henriquez
2010/0141153 A1 6/2010 Recker
2010/0247247 A1 9/2010 Neville
2011/0173911 A1 7/2011 Propst
2011/0227489 A1 9/2011 Huynh
2011/0253126 A1 10/2011 Yin et al.
2012/0003051 A1 1/2012 Plotkin
2012/0058299 A1 3/2012 Serwin
2012/0162965 A1 6/2012 Takeuchi
2012/0299489 A1 11/2012 Sakuragi
2013/0019549 A1 1/2013 Henriquez
2013/0205694 A1 8/2013 Stahl, Jr.
2013/0305643 A1 11/2013 Singleton et al.
2014/0175996 A1 6/2014 Yoon
2015/0043212 A1 2/2015 Coffey
2015/0191909 A1 7/2015 Linares, III
2015/0270700 A1 9/2015 Tang
2015/0275521 A1 10/2015 Bader et al.
2015/0368898 A1 12/2015 Stahl, Jr.
2016/0034137 A1 2/2016 Foster et al.
2016/0037582 A1 2/2016 Novikov
2016/0130812 A1 5/2016 Karle et al.
2016/0217957 A1 7/2016 Kumar
2016/0241002 A1 8/2016 Tremaine
2017/0063051 A1 3/2017 Sharp
2017/0067256 A1 3/2017 Garcia Acon et al.
2017/0089763 A1 3/2017 Freer
2017/0138542 A1 5/2017 Gielen
2017/0154744 A1 6/2017 Hanson
2017/0169979 A1 6/2017 Mittelstadt
2017/0342736 A1 11/2017 Roshinsky
2018/0038103 A1 2/2018 Newmayr
2018/0127968 A1 5/2018 Ziehl et al.
2018/0327979 A1 11/2018 Szekely
2018/0363893 A1 12/2018 Cheng
2019/0006827 A1 1/2019 Gintz
2019/0089146 A1 3/2019 Li
2019/0120438 A1 4/2019 Wan
2019/0144340 A1 5/2019 Hesse et al.
2019/0166661 A1 5/2019 Gao
2019/0245335 A1 8/2019 McKenny
2019/0316350 A1 10/2019 Pilz
2020/0048904 A1 2/2020 Dombowsky et al.
2020/0119551 A1 4/2020 Saylor
2020/0208399 A1 * 7/2020 Keller ..... E04B 7/024
2020/0240144 A1 7/2020 Hou et al.
2021/0087773 A1 3/2021 Lim

(56) References Cited

U.S. PATENT DOCUMENTS

| | | | |
|---|---|---|---|
| 2021/0087809 | A1 | 3/2021 | Raccuia |
| 2022/0010545 | A1 | 1/2022 | Recker et al. |
| 2022/0034090 | A1 | 2/2022 | Espada et al. |
| 2022/0037861 | A1 | 2/2022 | McKimmey |
| 2022/0067851 | A1 | 3/2022 | Johnson |
| 2022/0162125 | A1 | 5/2022 | Perrino et al. |
| 2022/0220034 | A1 | 7/2022 | Perrino et al. |
| 2022/0220734 | A1 | 7/2022 | McManus |
| 2022/0220736 | A1 | 7/2022 | Rasmussen |
| 2022/0332646 | A1 | 10/2022 | Perrino et al. |
| 2023/0295043 | A1 | 9/2023 | Knoebel et al. |
| 2024/0026617 | A1 | 1/2024 | Derian |

FOREIGN PATENT DOCUMENTS

| | | | |
|---|---|---|---|
| CN | 104465638 | | 3/2015 |
| CN | 104963432 | A | 10/2015 |
| CN | 106348709 | A | 1/2017 |
| CN | 108374489 | A | 8/2018 |
| CN | 209277363 | U | 8/2019 |
| CN | 209353517 | U | 9/2019 |
| CN | 209384520 | U | 9/2019 |
| CN | 110357504 | A | 10/2019 |
| CN | 111039604 | A | 4/2020 |
| CN | 111576673 | A | 8/2020 |
| CN | 211228878 | U | 8/2020 |
| CN | 111749352 | A | 9/2020 |
| CN | 211499219 | U | 9/2020 |
| CN | 111848067 | A | 10/2020 |
| CN | 212176183 | U | 12/2020 |
| CN | 212427619 | U | 1/2021 |
| CN | 112575907 | A | 3/2021 |
| CN | 213115208 | U | 5/2021 |
| CN | 112924066 | | 6/2021 |
| CN | 114045963 | A | 2/2022 |
| CN | 114219172 | A | 3/2022 |
| CN | 114818078 | A | 7/2022 |
| CN | 115010011 | | 9/2022 |
| CN | 218374462 | U | 1/2023 |
| CN | 220620433 | U | 3/2024 |
| DE | 102021121101 | | 8/2021 |
| EP | 2314771 | A2 | 4/2011 |
| FR | 2717197 | A1 | 9/1995 |
| GB | 1396128 | A | 6/1975 |
| GB | 2554506 | A | 4/2018 |
| JP | 30877598 | U | 8/2002 |
| JP | 2003-293474 | A | 10/2003 |
| JP | 2010043192 | A | 2/2010 |
| JP | 201307605 | A | 4/2013 |
| JP | 2016211202 | A | 12/2016 |
| KR | 20130074238 | A | 7/2013 |
| WO | 2002040593 | A2 | 5/2002 |
| WO | 2011123873 | A1 | 10/2011 |
| WO | 2013182587 | A1 | 12/2013 |
| WO | 2015135440 | A1 | 9/2015 |
| WO | 2020014732 | A1 | 1/2020 |
| WO | 2020050951 | A1 | 3/2020 |
| WO | 2020154451 | A1 | 7/2020 |
| WO | 2021154639 | A1 | 8/2021 |

OTHER PUBLICATIONS

"Decoupling Explained", www.tmsoundproofing.com/decoupling-explained.html, 14 pages.
"Development of Lightweight Concrete Subfloor with Ethylene Vinyl Acetate (EVA) Aggregates Waste to Reduce Impact Sound Inflooring System", http://dyna.medellin.unal.edu.com, by Fernanda Pacheco et al. pp. 290-295.
Cambridge Sound Management, "Explaining the Speech Privacy Potential Rating", 3 pages.
"How to Soundproof a Wall", www.bobvilla.com/articles/how-to-soundproof-a-wall/ , By: Steffani Cameron & Bob Villa, Sep. 24, 2021, 8 pages.
"Noise Isolation Class", https://asastandards.org/Terms/noise-isolation-class/, 3 pages.
"Perforated Panel Absorbers vs Diaphragmatic Absorbers", By Dennis Foley, May 19, 2013, 14 pages.
"Speech Privacy Class for Rating the Speech Privacy of Meeting Rooms", By John S. Bradley and Bradford N. Gover, vol. 36., No. 3, (2008), pp. 22-23.
Non-Final Office Action mailed on Feb. 25, 2020, serial U.S. Appl. No. 16/250,727, filed Jan. 17, 2019, applicant: Juntao Zhang, 21 pages.
Notice of Allowance dated Jun. 11, 2019, U.S. Appl. No. 16/197,003, filed Jan. 20, 2018applicant: Shanfu Gao, 15 pages.
International Search Report mailed May 18, 2022, in International Application No. PCT/US22/17555, 23 pages.
International Search report, mailed on May 16, 2023, International Application No. PCT/US 22/53216, 16 pages.
Design U.S. Appl. No. 29/727,329 for McKimmey publication U.S. Appl. No. 29/727,329 A1, (Year 2022).
Notification of Transmittal of the International Search Report and the Written Opinion of the International Searching Authority in International Application No. PCT/US2024/015816, dated Mar. 19, 2024.
Column Base-Hollow Section Column (EN) Idea StatiCa, https://www.ideastatica.com/support-center/column-base-hollow-section-column, 9 pages.
S El Gamal an S Al Saadi, Developing of Lightweight Concrete Sandwich Wall Panels with Good Thermal Insulation Properties for Sustainable Buildings, IOP Conference Series: Earth and Environmental Science 1026 012014, 2022, 10 pages.
Herman Tawil et al., Mechanical and Thermal Properties of Composite Precast Concrete Sandwich Panels, Buildings 2022, 12, 1429, https://doi.org/10.3390/buildings12091429, 14 pages.
Powered Vacuum Lifters, with Side Gripping Pad Attachments, https://anver.com/vacuum-lifters/vacuum_rotators_and_sidegrips/, 6 pages.
Two Pad Side Grip Lifting Frames, Ski Lifters, indiamart.com/proddetail/suction-lifting-equipment-2850737928948.html.
International Preliminary Report on Patentability dated Jun. 27, 2024, from International Application No. PCT/US2022/053216, 6 pages.
International Search Report and the Written Opinion of the International Search Report dated Aug. 22, 2024, from International Application No. PCT/US2024/031827.
Zandes, "The role of thermal mass materials in net-zero energy buildings", International Hellenic University [online], pp. 1-40, Dec. 2013 [retrieved on Aug. 14, 2024].Retrieved from the internet:https://repository.ihu.edu.gr/xml/bitstream/handle/11544/417/Zandes%20Thomas%20dissertation.pdf?sequence=1, entire document (especially Abstract & p. 7, para 1, p. 15, para 3, p. 25, para 1, p. 32, para 1).
Vo et al., "Dispersing effectiveness of a phosphated polycarboxylate in a- and B-calcium sulfate hemihydrate systems" Constr.Build. Mater., Dec. 6, 2019 (Dec. 6, 2019), 237, 117731. entirety of document especially p. 3, col. 1, para 3.
International Search Report and Written Opinion from International Application No. PCT/US24/31746 mailed on Sep. 10, 2024.
International Search Report and Written Opinion from International Application No. PCT/US24/31487 mailed on Sep. 10, 2024.
International Search Report and Written Opinion from International Application No. PCT/US24/31752 mailed on Sep. 6, 2024.
International Search Report and Written Opinion from International Application No. PCT/US24/31489 mailed on Aug. 28, 2024.
International Search Report for International Application No. PCT/US2025/016472 dated Apr. 23, 2025.
International Search Report for International Application No. PCT/US2025/021004 dated May 22, 2025.
International Search Report for International Application No. PCT/US2025/023732 dated Jun. 18, 2025.
International Search Report for International Application No. PCT/US2025/023736 dated Jun. 16, 2025.

* cited by examiner (a)

(b)

METHOD AND ARRANGEMENT FOR CONSTRUCTING AND INTERCONNECTING PREFABRICATED BUILDING MODULES

RELATED APPLICATION(S)

This application is a divisional of the co-pending U.S. patent application Ser. No. 17,678,635, filed Feb. 23, 2022, and titled "METHOD AND ARRANGEMENT FOR CONSTRUCTING AND INTERCONNECTING PREFABRICATED BUILDING MODULES," which claims priority under 35 U.S.C. § 119 (e) of U.S. Provisional Patent Application Ser. No. 63/152,793, filed Feb. 23, 2021, and titled "Building Blocks in Construction Technology," both of which are hereby incorporated by reference in their entireties.

FIELD OF THE INVENTION

The embodiments discussed in the present disclosure are generally related to construction technology. In particular, the embodiments discussed are related to construction and interconnection of prefabricated building modules for use in construction technology.

BACKGROUND OF THE INVENTION

Existing construction technologies involve one-off (e.g., customized) build-on site approaches in which construction material is brought to the construction site. This has been the traditional methodology and approach for many years but has certain inherent challenges. Such challenges include non-availability of skilled workforce (e.g., manual labor), heavy and expensive on-site machinery, incorrect estimate of completion time of construction projects, delays in delivery of projects, weather, quality, wastage of materials, noise and air pollution, and cost involved in disposal of debris. This approach is also "one-off" and provides no repeatability or scalability leverage. Each building or project is done differently, and results vary widely.

Further, execution of construction projects needs an ensemble of technologies/domains such as, structural integration, civil engineering, mechanical joints, material science, etc. Although, there have been significant advancements in construction technologies, due to the above factors, the average cost of construction and the effective cost of owning a house is still high for a majority of aspiring owners.

In order to address the aforesaid shortfalls of these build-on site approaches, usage of prefabricated building modules for construction is also commonplace and has been in practice for some time. For example, building modules could be prefabricated at factories under factory scaling, repeatability, and in-factory conditions, and then delivered to a building site for expeditious on-site assembly. Prefabricated building modules are broadly classified into volumetric and non-volumetric types. A volumetric prefabricated building module is understood to persons skilled in the art as one which has a volume defined by a structured enclosure or boundary. A non-volumetric type is one wherein panels and other prefabricated components are stacked or packed together for storage and shipment with minimum space in-between. For some construction sites, for example, remote sites which are in primitive locations or otherwise too difficult to access, or where resources are difficult to acquire, or when weather conditions or environmental restrictions do not permit, construction using prefabricated modules are often the only practical option.

The prefabricated components typically comprise a solid roof, floor, and wall panels that are joined together during on-site assembling. In typical configurations, wall panels, roof panels, and floors are interconnected, for example, by an upwardly opening U-shaped profile bracket attached to a flooring member.

However, there remains a need in the art for constructing a modular housing system based on improved and robust prefabricated components to withstand load, climate changes, and daily wear and tear as may be subjected to any house or establishment. Alternatively, there lies a need for an improved and better quality roof, wall, floor panels, etc., as may be used for constructing the modular housing system.

Further, there lies a need for mechanical or electromechnical connectors for all the prefabricated components for simplifying and standardizing a connection across all the panels, allowing adjustment and/or replacement of the panels upon or after installation, and yet nonetheless providing a robust, dependable, water-tight interconnection. Such interconnection needs to be as robust as a permanent connection of a non-modular building system made of non-prefabricated components to not compromise quality.

SUMMARY OF THE INVENTION

Embodiments for constructing and interconnecting building blocks/modules in construction technology are disclosed that address at least some of the above challenges and issues.

In a first aspect, the present subject matter is directed to a modular building system, comprising a wall panel and a floor panel. The wall panel comprises a plurality of sheets disposed adjacently, a horizontal member supported along a bottom horizontal edge formed by adjacent disposition each of said sheets, and a plurality of vertical studs integral to the horizontal member and extending vertically downward from the horizontal member. The floor panel comprises a rail rigidly fixed to the ground or other foundation and defining an enclosure to receive the plurality of vertical studs of the wall panel and thereby vertically support the wall panel upon the foundation.

In an alternative embodiment, the plurality of sheets of the wall panel comprises a gypsum board, a plurality of metal studs to support the gypsum board, a plurality of metal column studs placed between the metal studs, mineral wool disposed between the metal studs, a sheathing board comprising a first cement board, an insulation layer, and an external cladding layer comprising a second cement board.

In an alternative embodiment, the modular building system further comprises a roof panel having a plurality of layers comprising one or more of a waterproofing membrane, a sheathing board, a plywood layer, a light gauge steel (LGS) based structure exhibiting a slope with respect to a surface of the waterproofing membrane, and a gypsum board ceiling. The roof panel further comprises a plurality of metal column studs interspersed in mineral wool above and below the LGS structure, wherein the mineral wool is held between the sheathing board above and below the LGS structure. An external cladding layer and an insulation layer are further provided.

In an alternative embodiment, each of the wall panel and the roof panel further comprises one or more connectors for achieving a connection with one or more of the wall panels and an other roof panel. The connector within the wall panel and the roof panel comprises at least one first vertical stud supported along a first vertical face, and at least one second vertical stud supported along a second vertical face opposite the first vertical face.

BRIEF DESCRIPTION OF THE DRAWINGS

Further advantages of the invention will become apparent by reference to the detailed description of preferred embodiments when considered in conjunction with the drawings. In the drawings, identical numbers refer to the same or a similar element.

DETAILED DESCRIPTION

Figure 1:
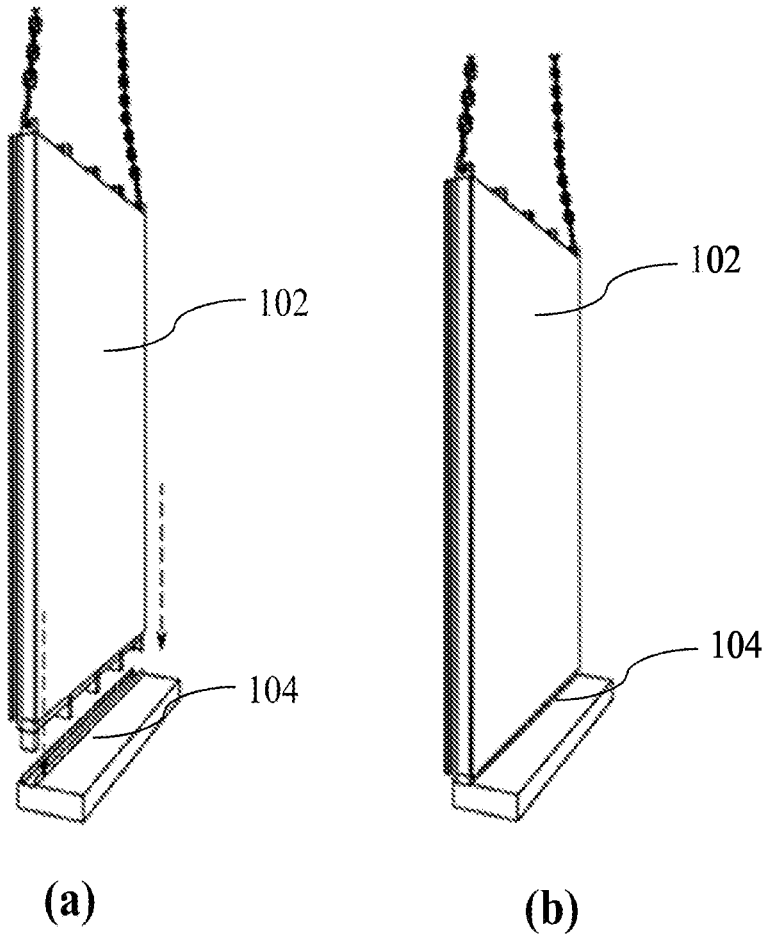
FIGS. 1(*a*) and (*b*) illustrate a wall panel and a floor panel during different stages of installation in construction technology in accordance with an embodiment.

The following detailed description is presented to enable any person skilled in the art to make and use the invention. For purposes of explanation, specific details are set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

With modernization in construction-related technologies, there has been a rapid shift from normal customized build on-site construction methodologies to construction using modules or blocks that can be built off-site. However, in such an approach, it may be of utmost concern that the modules are manufactured in such a manner that they are easy to transport, integrate, assemble, or mount on any construction site. Current manufacturing technologies fail to address this concern. The embodiments of the present disclosure address this concern by providing improved, multi-layered and robust prefabricated components.

Yet another important consideration may be that the boundary conditions of each module are sealed from the outside as well as inside continuously. In other words, the modules need to be structurally, mechanically, and aesthetically well connected/integrated with each other. Such seamless integration of modules on the construction site remains an unresolved challenge. The embodiments of the present disclosure address this challenge at least by providing improved and robust interconnecting arrangements among the prefabricated components.

While wooden studs were traditionally used to withstand a load of walls (interior and exterior) and roofs, steel studs have been employed and preferred over wooden studs in the construction business due to their various advantages. For example, steel studs are fire-resistant, rigid, lightweight, stable, and dimensionally controllable, and exhibit more resistance to earthquakes and tornadoes. In addition, when compared with wooden studs, steel studs remain unaffected by problems like rotting, cracking, shrinking, and termite-attack.

Construction technology in this disclosure proposes the use of fully loaded 2D Light Gauge Steel (LGS) panels for roof and walls coupled with other building blocks. The current disclosure also provides various embodiments of bathroom pods, modular kitchen, precast foundation(s), and floors, to construct high quality, highly sustainable homes/buildings while addressing the above noted concerns and challenges. The disclosed solution/architecture provides an improved multi-layered assembly of prefabricated components such as roof panels, floor panels, and wall panels to withstand load, climate changes, and daily wear and tear as may be subjected to any house or establishment. Further, the disclosed solution/architecture provides mechanical or electromechnical connectors (e.g. female-male pair based or otherwise "matched" connectors) for all the prefabricated components for simplifying and standardizing a connection across all the panels, which in turn allows adjustment and/or replacement of the panels upon installation, and last but not the least provides a robust, dependable, water-tight interconnection amongst the panels.

Certain terms and phrases have been used throughout the disclosure and will have the following meanings in the context of the ongoing disclosure.

"LGS" refers to Light Gauge Steel framing, which is a construction technology that uses cold-formed steel as a construction material.

"MEP" refers to Mechanical, Electrical, and Plumbing technical disciplines for making any building site suitable for human occupancy.

"HVAC" refers to Heating, Ventilation, and Air Conditioning systems for providing heating and cooling to any building site.

"R-value" refers to a measure of thermal resistance, where R stands for resistance to heat flow. An R-value is specified for every layer of material, and United States energy codes only refer to the R-values of insulation layers in the prescriptive R-value compliance path.

"IECC" refers to the International Energy Conservation Code. IECC provides three paths for compliance for a building envelope. The first path specifies the required minimum level of insulation in the wall, i.e., R-value; the second path specifies U-factors for the building envelope components; and the third path, in which an annual energy use analysis is required, is based on the total building energy cost budget for heating, cooling, and service water heating.

"SFH" refers to single-family home, which typically has one unit intended to house a single family.

"Wall panel" refers to a prefabricated multi-layered wall fabricated at an offsite location and installed on-site, wherein "on-site" denotes a construction site and "offsite" denotes away from the construction site.

"Floor panel" refers to a prefabricated multi-layered floor fabricated at an offsite location and installed on-site.

"Roof panel" refers to a prefabricated multi-layered truss based roof fabricated at an offsite location and installed on-site.

"Horizontal track" refers to a rail component to vertically support components upon a foundation, ground or other origin.

"Vertical studs" refers to metallic columns or protrusions extending from a structure and capable of being fastened to another structure to connect both structures.

"Swaged studs" refers to male metallic connectors for mechanical linkage.

"Unlipped studs" refers to female metallic connectors for acting as a receptacle to the "Swaged studs".

"Modular" refers to any mechanism involving arrangement of individual and independent blocks.

In accordance with the embodiments of the invention a modular building system comprises a wall panel, a floor panel, and a roof panel. The wall panel comprises a horizontal member supported along a bottom horizontal edge of the wall panel and a plurality of vertical studs integral to the horizontal member and extending vertically downward from the horizontal member. A floor panel comprises a rail disposed rigidly fixed to the ground and defining an enclosure to receive the plurality of vertical studs of the wall panel to vertically position the wall panel upon the ground.

In accordance with the embodiments of this disclosure, the rail is a horizontal track riveted to the ground and accommodates the vertical studs of the wall panel.

In accordance with the embodiments of this disclosure, the vertical studs of the wall panel are screw-fastened to the horizontal track.

In accordance with the embodiments of this disclosure, the wall panel further comprises one or more connectors for achieving a connection with an other wall panel, said one or more connectors comprising at least one of: a first vertical stud supported along a first vertical edge of the wall panel, and a second vertical stud supported along a second vertical edge opposite the first vertical edge of the other wall panel.

In accordance with the embodiments of this disclosure, the first vertical stud and the second vertical stud comprise a pair of male and female connectors to connect the wall panel with the other wall panel, and wherein the first vertical stud of the wall panel connects with the second vertical stud of the another wall panel through a screw fastener.

In accordance with the embodiments of this disclosure, the wall panel further comprises a plurality of sheets disposed adjacently, wherein the plurality of sheets of the wall panel comprise one or more of: a gypsum board, a mineral wool disposed between metal studs, a sheathing board comprising a first cement board, an insulation layer, and an external cladding layer comprising a second cement board.

In accordance with the embodiments of this disclosure, a roof panel has a plurality of layers comprising one or more of a water proofing membrane, a sheathing board, a plywood layer, and a false ceiling.

In accordance with the embodiments of this disclosure, the roof panel further comprises a light gauge steel (LGS) based structure having an elevation angle relative to a surface of the water proofing membrane, a plurality of metal column studs interspersed in mineral wool above and below the LGS structure, an arrangement to connect with the wall panel, and a cantilever arrangement.

In accordance with the embodiments of this disclosure, the roof panel further comprises one or more connectors for achieving a connection with one or more of the wall panel and another roof panel, said connectors comprising at least one first vertical stud supported along a first vertical face, and at least one second vertical stud supported along a second vertical face opposite the first vertical face.

In accordance with the embodiments of this disclosure, the at least one first vertical stud and the at least one second vertical stud comprise a pair of male and female connectors to connect the roof panel with an other roof panel, and wherein the at least one of the roof panel connects with the at least one second vertical stud of the other roof panel through a screw fastener.

FIG. 1 illustrates a wall panel and a floor panel in construction technology in accordance with an embodiment. As such, FIG. 1 illustrates building blocks comprising a wall panel 102 and a floor panel 104 in construction technology in accordance with an embodiment of the present disclosure. The building blocks include the wall panel 102, the floor panel 104, and a roof panel (shown below in FIG. 7). In this embodiment, although three building blocks are illustrated, it will be apparent to a person with ordinary skill in the art that a building may also be constructed using any number of building blocks on a precast modular foundation. In an embodiment, each of the aforesaid building blocks may include sub-modules or sub-blocks that can be independently manufactured and assembled in a factory setting. In an embodiment, the building blocks may be assembled as part of a modular home, where the modular blocks are built entirely in a factory setting and subsequently assembled or mounted on the construction site. In another embodiment, one or more building blocks may be built in the factory while other building blocks of the building may be built on-site. In an embodiment, any combination of building blocks may be built on-site and off-site to construct a home/building. For each building block illustrated in FIG. 1, placement details will be explained in detail in forthcoming figures.

The floor panel 104 comprises a rail or a horizontal track, i.e. a swaged/unlipped stud that provides an enclosure and thereby acts as a receptacle for the studs of the wall panel 102. The horizontal track is rigidly fixed (e.g., riveted) to the ground and defines an enclosure to receive a plurality of vertical studs (shown in FIG. 2 and FIG. 3 below) of the wall panel 102 and thereby vertically support the wall panel 102 upon the ground. As shown in FIG. 1*a*, the wall panel 102 may be lifted and dropped upon the horizontal track of the floor panel 104. The horizontal track of the floor panel 104 acts as the receptacle for the plurality of vertical studs which are provided at the bottom of the wall panel 102. As further shown in FIG. 1*b*, the wall panel 102 is placed upon the floor panel 104. In such a scenario, the vertical studs of the wall panel 102, once received within the floor panel 104, are fastened to the walls of the horizontal track of the floor panel 104 on both interior and exterior sides, such as by screw fastening. As may be understood, the screw fastening affords replaceability, versatility, time efficiency of fastening and robustness. Here the fastening may be also construed to cover other analogous mechanisms, such as welding or self-tapping screw fastening, which requires no pilot holes or prelocation. In an example, the receiving of the vertical studs within floor panel 104 may comprise coupling with a male-female mechanical connection such that vertical studs may comprise a male connector and the floor panel 104 may comprise a female connector.

Figure 2:
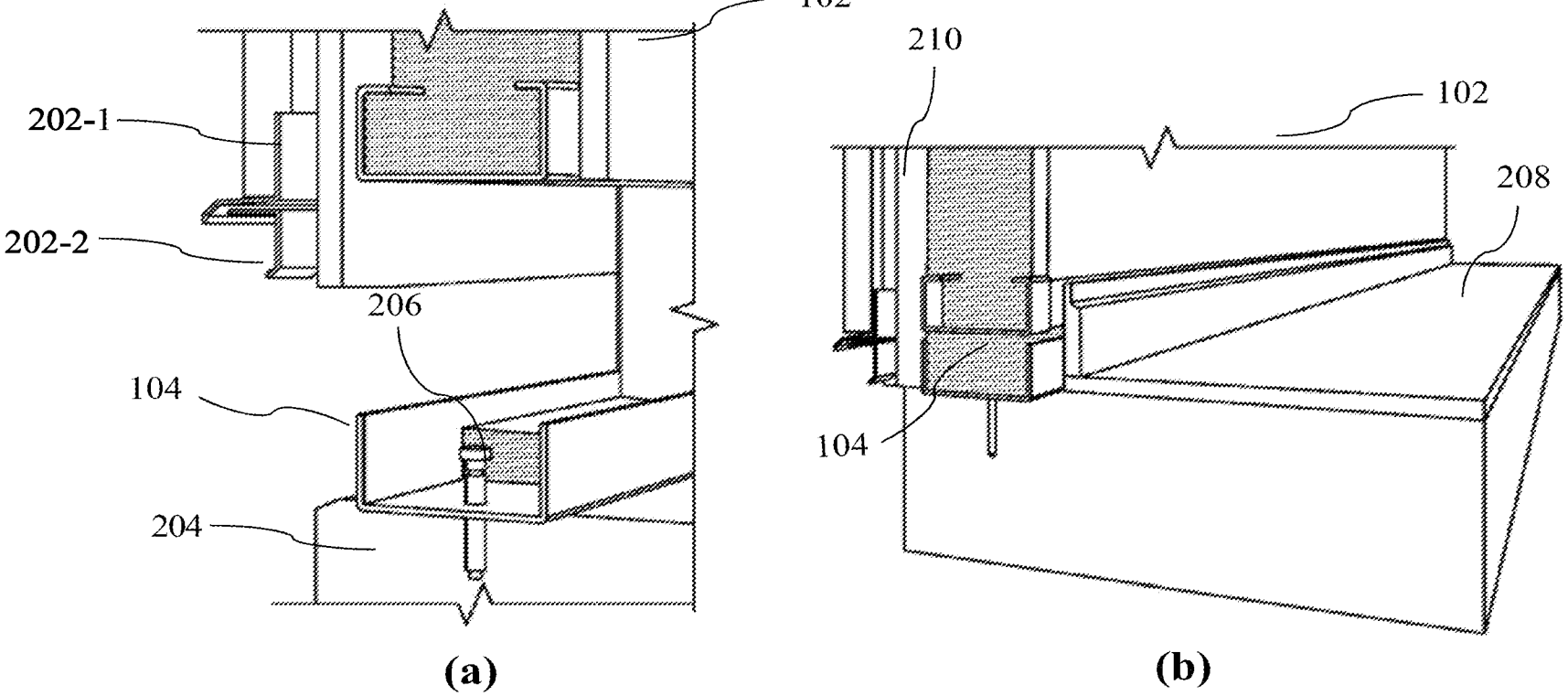
FIGS. 2(*a*) and (*b*) illustrate, respectively, the wall panel of FIG. 1 as mounted upon the floor panel and a cross-sectional view of the wall panel in accordance with an embodiment.

FIGS. 2(*a*) and (*b*) illustrate, respectively, the wall panel 102 as mounted upon the floor panel 104 and a cross-sectional view of the wall panel 102 in accordance with an embodiment. FIG. 2 will be explained in conjunction with the description of FIG. 1. In particular, FIG. 2 illustrates the wall panel 102 as mounted upon the floor panel 104 and a cross-sectional view of the wall panel 102 in the mounted state.

FIG. 2*a* shows an exploded view depicting the wall panel 102 above, and thereby detached from, the floor panel 104. One face of the wall panel 102 may be provided with a pair of adjacently placed termination flashings 202-1 and 202-2 at the bottom of the wall panel 102. As may be understood, termination flashing may be a multi-purpose, preformed, professional way to attach a wide variety of construction waterproofing, drainage boards, and panel systems. The termination flashing 202-1 may be powder-coated aluminum termination flashing which, as one example, may be Tamlyn or equivalent without departing from the scope of the ongoing description. The termination flashing 202-2 may be powder-coated aluminum L flashing or equivalent without departing from the scope of the ongoing description.

As one example, the horizontal track of the floor panel 104 is riveted or otherwise fastened to a foundation or the ground 204, for example, through a pneumatic pin fastener 206. As may be understood, the pneumatic pin fastener 206 is a rivet type connector that is driven by tools powered by air delivered from an air compressor. The foundation 204 may be formed of reinforced cement concrete (RCC) or any equivalent without departing from the scope of the ongoing description. In another example, the horizontal track 104 may also be installed within the foundation 204 by using, for example, a cement concrete mixture instead of the pneumatic pin fastener 206.

In another example, instead of RCC, the foundation or ground 204 may itself be a prefabricated panel comprising an R-15 Rigid Polyurethane Foam Insulation layer that may be placed contiguously followed, sequentially, by a Moisture Barrier layer, a Granular fill layer, and a Subgrade. In an embodiment, the thickness of the R-15 Rigid Polyurethane Foam Insulation layer may be 3 inches. In an embodiment, alternatively batt insulation may be used instead of R-15 Rigid Polyurethane Foam Insulation layer. The quick join-and-attach features of the wall panel 102 facilitate rapid placement, assembly, and dimensional predictability amongst other things.

FIG. 2*b* shows the wall panel 102 and the floor panel 104 connected to each other and a subsequent floor finishing and skirting, as may be performed post connection, to achieve a seamless connection. More specifically, following the wall panel 102 placement over the floor panel 104, finished flooring and base trim may be performed. A result of such finishing has been denoted by reference number 208. Additionally, a zip system sheathing 210 may be provided as insulation post fastening of the wall panel 102 with the floor panel 104. In an example, the insulation as provided by zip system sheathing 210 may be thermal, electrical or a combination of both. It will be appreciated that, as in other figures described herein, the layers shown in FIG. 2(*b*) may be coupled others, such as through intermediate layers (not shown).

Zip-type sheathing provides several advantages. For example, the rigid foam isolation board is attached, providing the building-code-required thermal break between the sheathing and the steel stud. Additionally, the zip outside the sheathing provides for direct mechanical/structural attachment of any siding (e.g., cement board, rain screen, masonry, stucco, etc.).

Figure 3:
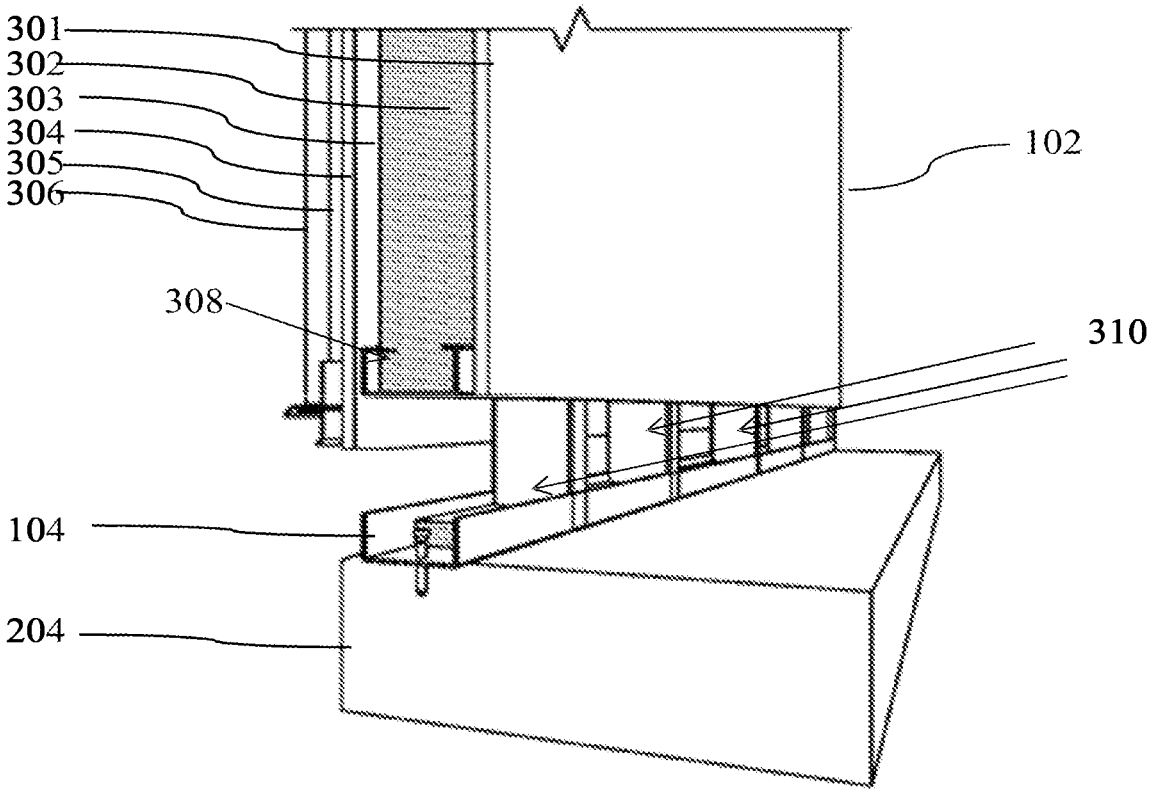
FIG. 3 illustrates an exploded view of the wall panel of FIG. 2 detached from the floor panel in accordance with an embodiment.

FIG. 3 illustrates an exploded view to depict the wall panel detached from the floor panel in accordance with an embodiment. FIG. 3 will be explained in conjunction with the descriptions of FIG. 1 and FIG. 2.

FIG. 3 illustrates an exploded view of the structure of FIG. 2, depicting the wall panel 102 above, and thereby detached from, the floor panel 104. Specifically, FIG. 3 illustrates an enlarged cross-sectional view of the wall panel 102 to depict a structural composition of the wall panel 102 in accordance with an embodiment. The wall panel 102, for example, may be a standard 4-feet grid-sized LGS wall panel, which is fully assembled in-factory using LGS for studs, structural framework with insulation, windows (exterior), doors (interior and exterior), and sheathing. As one example, the wall panel 102 may be 8 feet wide and 11 to 14 feet high. However, the dimensions of wall panel 102 are for illustration purposes only and may change in accordance with the requirements and/or design specifications, amongst any other factors within the scope of the present disclosure. In an embodiment, the interior of the wall panel 102 may optionally include unplasticised polyvinyl chloride (UPVC) windows and the surrounding/remaining portion of the wall panel 102 may be layered by interior finishes.

Figure 4:
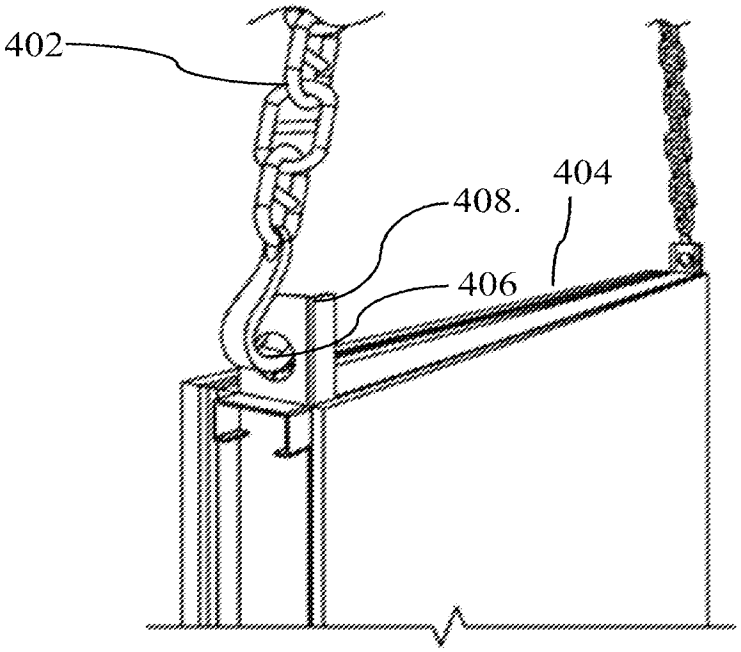
FIGS. 4 (*a*) and (*b*) illustrate an arrangement for lifting the wall panel in accordance with an embodiment.
Figure 4:
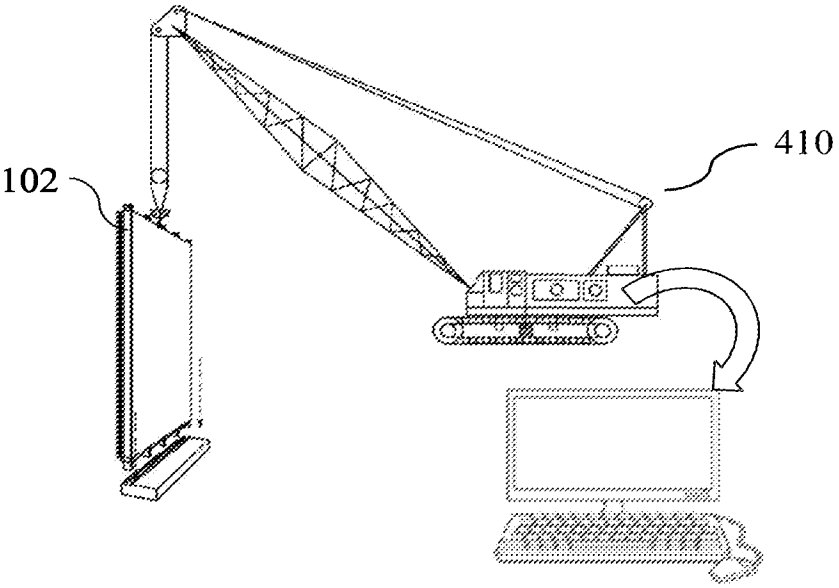
Figure 5:
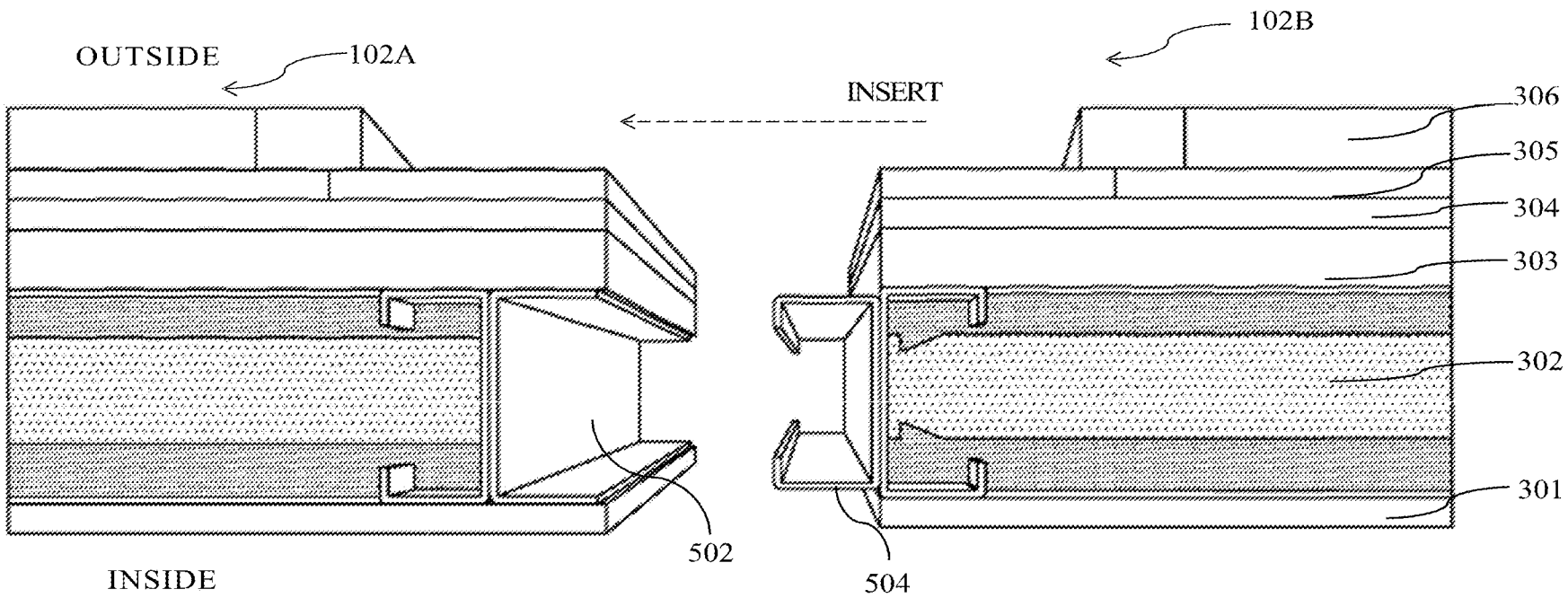
FIG. 5 illustrates an elevation view depicting a wall panel to wall panel connection in accordance with an embodiment.
Figure 6:
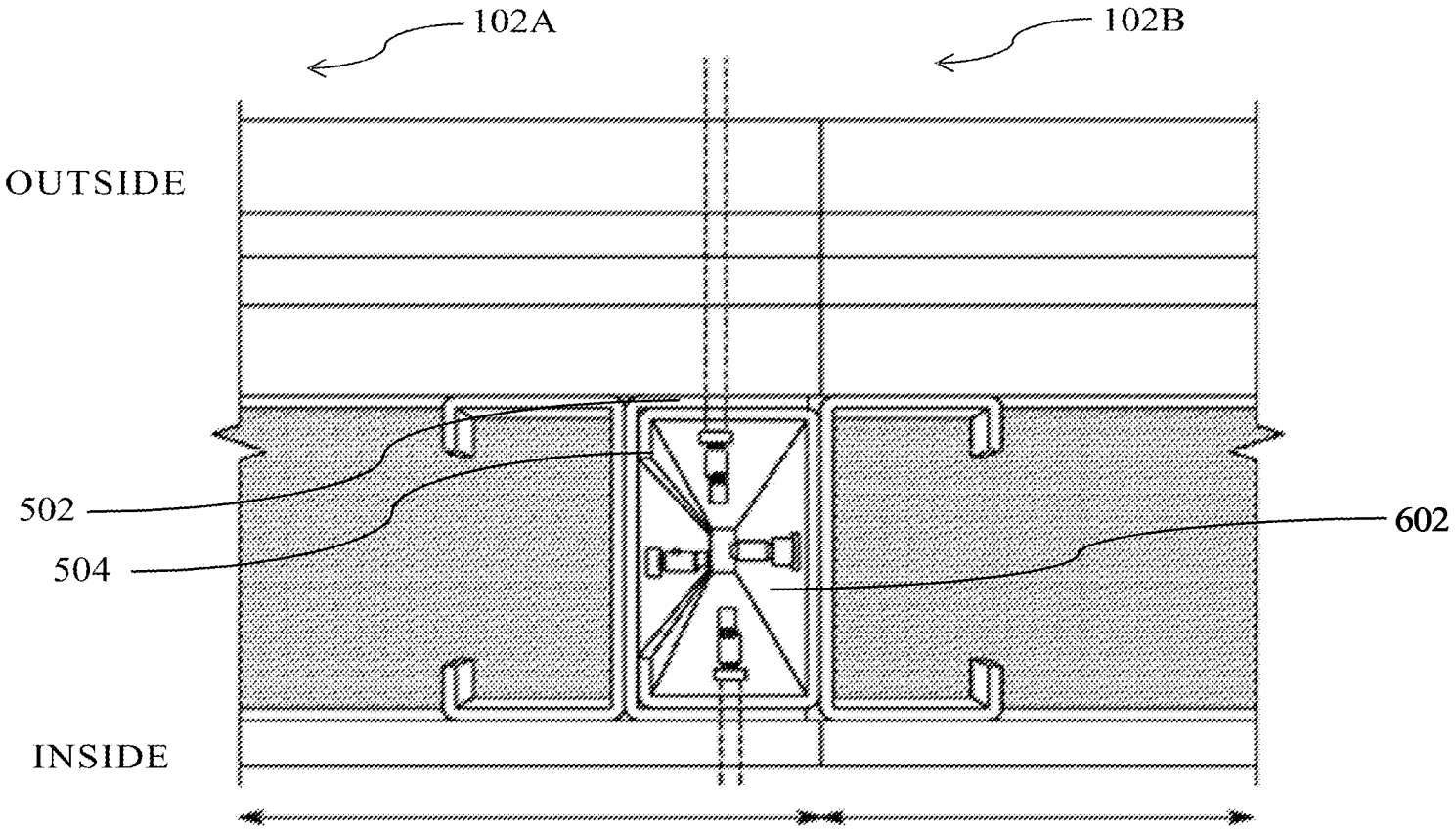
FIG. 6 illustrates an elevation view depicting an integrated view of the wall panel to wall panel connection of FIG. 5 in accordance with an embodiment.

There are notable advantages of the depicted wall panel 102 such as its quick-join features which allow for the rapid assembly of extendable walls, and enable dimensional predictability as further depicted in FIG. 5 and FIG. 6. Further, lifting features and packing of the wall panel 102 allow for fast and accurate logistics and assembly on-site as further depicted in FIG. 4. Overall, a modular design of the wall panel 102 as depicted in FIG. 3 allows for flexible configuration, manufacturing, and assembly processes. Additionally, the combined joining techniques allow for a very high level of finish (in some cases, as high as 85%) of components directly out of factory.

As depicted in the cross-sectional view of the wall panel in FIG. 3, the wall panel 102 comprises a plurality of sheets or layers 301-306 disposed adjacently. On the interior side of the wall panel 102, a gypsum board 301 is placed. In an embodiment, the gypsum board 301 may have a thickness of about 1-1.5 inches. A gypsum board may be understood as a drywall used as a building material for wall, ceiling, and partition systems in building structures.

The gypsum board 301 of the wall panel 102 may be supported by cold formed steel (CFS) based frames. Metal studs as a part of frame of the wall panel 102 may extend from the CFS frames. In one embodiment, the metal studs are 3.5-inch wide studs. However, such dimensions of metal studs are for illustration purposes only and may vary based on internal and external factors or other specifications. Further, mineral wool or R-13 Batt insulation 302 may be placed between the metal studs, for example, in the form of a close cell spray configuration for thermal and electrical shock prevention due to the presence of metal studs. As may be understood, in some embodiments the metal studs may be needed for a rigid frame of the wall panel 102 but remain prone to electrical shock and thermal heating. The R-13 Batt insulation provides insulation for the metal studs. In one embodiment, the zip sheathing has 1 inch foam board attached directly to the steel studs (on the outside portion of the wall and/or roof trusses) to provide an electrical and thermal break. Typically, the insulation between the studs on the inside surface of the walls, trusses, or both is to meet any required local building R performance/standards. In an embodiment, the mineral wool has a thickness of about 3.5 inches. However, the thickness of the mineral wool 302 may vary based on internal and external factors.

After the mineral wool 302 (e.g., traversing from the innermost to the outermost layer), a rigid insulation layer 303 is placed, preferably to provide a thermal break between the steel studs and outside finishes. In an embodiment, the rigid insulation layer 303 may have a thickness of about 1 inch and may vary based on internal and external factors. In another embodiment, the rigid insulation layer 303 may comprise a Zip system R-6 rigid foam insulation board.

Subsequent to the layer of rigid insulation 303, a sheathing board 304 is placed to provide both structural integrity and an outside surface to mount finish, roof materials, or both. In an embodiment, the sheathing board 304 is "Zip System 7/16 inches plywood (OSB) sheathing." In another embodiment, the sheathing board 304 may be an Oriented strand board (OSB), MgO, cement board, etc. In another embodiment, the sheathing board 304 may have a thickness of about 0.5 inches. However, the dimensions of the sheathing board 304 are for illustration purposes only and may vary based on various factors.

Next to the sheathing board 304, an external cladding layer 305 is placed to provide the functionality of an external cement board as understood to a person skilled in art of building materials. In an embodiment, the external cladding layer 305 may be a cement board, about 5/16 inches thick. However, a person skilled in the art may select other available materials for external cladding layer 305 and accordingly select thickness based on design and purpose. The external cladding layer 305 provides an outside wall finish and, as some examples, can include brick, stucco, rainscreen, metal, porcelain tile, etc., or another material, similar to the zip outside layer, to provide an easy mechanical connection of outside finishes. The external cladding layer 305 may be joined with the sheathing board 304 using connector or joining means such as metal clamps 306 for cladding. The metal clamps 306 maybe "1 inches×2 inches" cement Board vertical members at 12 inches off center or 12 inches O.C. The number of metal clamps 306 to be used may depend on the number of wall panels. In an embodiment, the metal clamps 306 may be distributed evenly or unevenly between the cladding 305 and the sheathing board 304 to maintain continuity of the wall panel 102.

It will be appreciated that the sequence of layers is exemplary. In other embodiments, the layers may be interposed in different sequences, some layers may be omitted, and others added.

Further, the wall panel 102 comprises a horizontal member 308 supported along a bottom horizontal edge formed by adjacent disposition of each of said sheets 301-306. The horizontal member 308 may be a metal stud or CFS frame. Further, a plurality of vertical studs 310 are integrated with the horizontal member 308 and extend vertically downward from the horizontal member 308.

Further, as explained above, the floor panel 104 may comprise the horizontal track which is an unlipped/insulated track installed or fastened to the foundation 204. As explained above, the horizontal track of the floor panel 104 receives the metal studs such as the vertical studs 310 to enable placement of the wall panel 102 upon the floor panel 104 thereby vertically supporting the wall panel 102 upon the ground. Thereafter, the vertical studs 310 are screw-fastened with the floor panel 104. As may be understood, screw fastening affords replaceability, versatility, time efficiency of fastening, and robustness.

FIGS. 4 (*a*) and (*b*) illustrate an arrangement for lifting the wall panel 102 in accordance with an embodiment. FIGS. 4 (*a*) and (*b*) will be explained in conjunction with the descriptions of FIGS. 1-3.

FIG. 4(*a*) illustrates an arrangement for lifting the wall panel 102, including lifting hooks or hangers 402 provided at a top track 404 of the wall panel 102. Further, a number of service holes 406 are provided at the top track 404 within a pair of extended CFS frames 408 for receiving the lifting hooks 402. Upon installation of the wall panel 102 upon the floor panel 104, the extended CFS frames 408 may be removed from the wall panel 102. In an example, vertical studs may also be provided at the top track 404 formed within the wall panel 102. An example roof panel as later depicted in FIG. 7 may be provided with a horizontal track like the floor panel 104 to receive the vertical studs mounted at the top track 404 and thereby vertically connect the roof panel with the wall panel 102.

FIG. 4(*b*) illustrates an example mechanism for holding and transferring the wall panel 102 using the arrangement for lifting the wall panel 102 as depicted in FIG. 4(*a*). In an example, the wall panel 102 may be hoisted, lifted, positioned through either a mechanical arrangement such as a pulley mechanism or electromechanically through a computer controlled crane 410 or an equivalent lifting mechanism, and a camera or other sensing means for aligning the walls and roof panels. Such lifting may be automated or semi-automated performed through a human operator and/or artificial intelligence.

FIG. 5 illustrates an elevation view depicting a wall panel to wall panel connection in accordance with an embodiment. FIG. 5 will be explained in conjunction with the descriptions of FIGS. 1-4.

FIG. 5 illustrates an elevation view depicting a wall panel to wall panel mechanical connection between any two wall panels 102A and 102B (collectively, 102) through cooperation between the vertical studs, i.e., an unlipped stud 502 of a first wall panel (102A) and a swaged stud 504 of a second wall panel (102B). The unlipped stud 502 acts as a receptacle and thereby receives the swaged stud 504 to connect the wall panels 102A and 102B adjacently. Both the unlipped stud 502 and the swaged stud 504 may be provided vertically along respective vertical edges (surfaces) of the wall panels 102A and 102B to thereby vertically connect the wall panels 102. Further, the unlipped stud 502 and swaged stud 504 comprise a pair of male and female connectors to connect wall panel 102A with the wall panel 102B.

With respect to the wall panel 102A, the unlipped stud 502 may be supported along a first vertical edge as shown in FIG. 5. Accordingly, although not shown in the FIG. 5, the swaged stud 504 may also be supported within the same wall panel 102A along a second vertical edge which is opposite or behind the first vertical edge. Further, for achieving the connection, the wall panel 102A may be pushed against a stationary wall panel 102B or vice-versa or both the panels 102A and 102B may be pushed against each other to enable insertion or securing of the swaged stud 504 within the unlipped stud 502. In an example, the force required for such a pushing operation is provided through either a mechanical arrangement such as a pulley mechanism or electromechanically through a computer controlled robotic arm (as later shown in FIG. 10*b*). Such pushing operation may be automated or semi-automated, performed through a human operator and/or artificial intelligence.

FIG. 6 illustrates an elevation view depicting an integrated view of the wall panel to wall panel connection in accordance with an embodiment.

FIG. 6 illustrates an elevation view depicting an integrated view of the wall panel to wall panel connection. The connection may be a mechanical connection between the two wall panels 102 through a screw-fastener securely attaching the unlipped stud 502 of the wall panel 102A with the swaged stud 504 of the wall panel 102B. The unlipped stud 502 and the swaged stud 504 may be metallic or any other alloy based studs. In other words, the unlipped stud 502 of the wall panel 102A receives the swaged stud 504 of the wall panel 102B and both are secured together through a screw fastener 602. As depicted in FIG. 6, the wall panels 102A and 102B are joined to form a continuous wall. In an example, at the junction between the two wall panels 102, there may be an expansion gap covered or otherwise hidden by extra cladding material. The dimensions of wall panels 102 depicted in FIGS. 1 to 6 are for illustration purposes only and may vary from one construction site to another.

Figure 7:
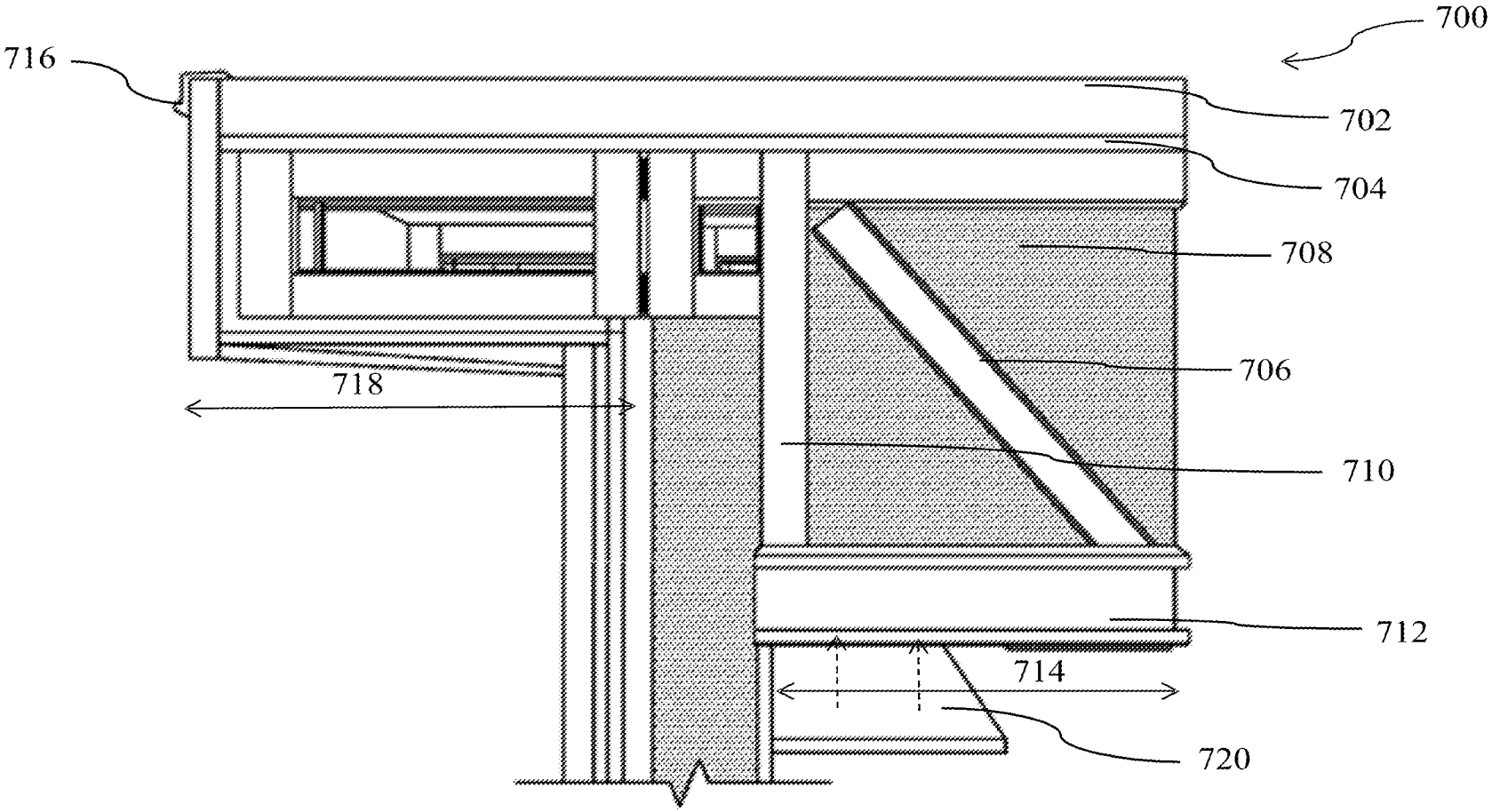
FIG. 7 illustrates an example roof panel in accordance with an embodiment.

FIG. 7 illustrates an example roof panel in accordance with an embodiment. FIG. 7 will be explained in conjunction with the description of FIGS. 1-6.

FIG. 7 illustrates an elevation view of a roof panel 700 in accordance with an embodiment. The roof panel 700 is built using LGS modular construction. Each exemplary roof panel 700 can be built as a module in-factory and completed with joists, plywood, insulation, and a false ceiling. As previously shown in FIG. 4, the roof panel 700 may be mounted on the top track 404 of wall panel 102 for quick attachment and assembly.

The roof panel 700 includes a waterproofing membrane 702 that may for example be a Thermoplastic Polyolefin (TPO) single ply roofing laid over an ISO rigid insulation which is followed by a rigid insulation layer. In an embodiment, the thickness of the rigid insulation layer may be about 2 inches. However, the dimensions of the rigid insulation layer may vary based on internal and external factors. The rigid insulation layer is followed by a plywood layer 704. The plywood layer 704 maybe a ⅝" OSB plywood decking. In some embodiments, the plywood layer 704 provides the same function as the outside wall finish described above.

The plywood layer 704 is supported by a light gauge steel (LGS) roof joist 706 with about ½ degree slope or alternatively exhibiting an elevation angle of 45°. It may be noted that the degree of slope may vary based on the specifics and requirements of the construction site. In an embodiment, the LGS roof joist 706 may be followed by a false ceiling 712 that in turn may comprise a gypsum board 712. In an embodiment, a batt type insulation 708 (e. g. R-38 Batt Insulation) may be used in the cavity of the roof panel 700 for R38 roof performance.

Metal column studs 710 above and below the LGS roof joist 706 may be covered by the batt type insulation's 708 mineral wool. In an embodiment, the metal column studs 710 may be about 3.5 inches by 3.5 inches and correspond to a CFS Truss 3.5 inches box design at 24 O.C. In an embodiment, the thickness of mineral wool covering the metal column studs 710 may be 3.5 inches. In an embodiment, the thickness of the plywood layer 704 on either side of the mineral wool is 0.5 inch.

In an example, although not shown in FIG. 7, the plywood layer 704 may be followed by rigid insulation and external cladding layers. The external cladding layer and the rigid insulation layer are attached to each other using metal clamps for cladding. In an embodiment, the external cladding layer may be 0.5 inch thick cement board. Aluminum (AL) coping may be used to cover the structural components and/or layers up to the external cladding layer for weather sealing.

Further, the roof panel 700 comprises a false ceiling, such as a gypsum board ceiling 712, at the bottom, and an access panel 714 (for example of about 12 inches) adjacent to the gypsum board ceiling 712 to facilitate fastening of trusses of the roof panel 700 with the wall panel 102. As may be understood, a truss is a structure that consists of members organised into connected triangles so that the overall assembly behaves as a single object. Upon such fastening, the access panel 714 may be finished with a cement board such as a gypsum board 720 to achieve a seamless connection. In addition, the roof panel 700 comprises at the edge a termination flashing 716 for waterproofing/sealing. A cantilever arrangement may be provided in the form of an overhang 718 that may be about 1 ft 4 inches long to render a balanced mounting of the roof panel 700 across the wall panel 102.

In accordance with an embodiment, the complete assembly from waterproofing membrane 702 at the top down to the gypsum board ceiling 712 at the bottom constitutes the roof panel 700. Various units or modules of the roof panel 700 as depicted may be joined and replicated to form a complete roof at any construction site.

Figure 8:
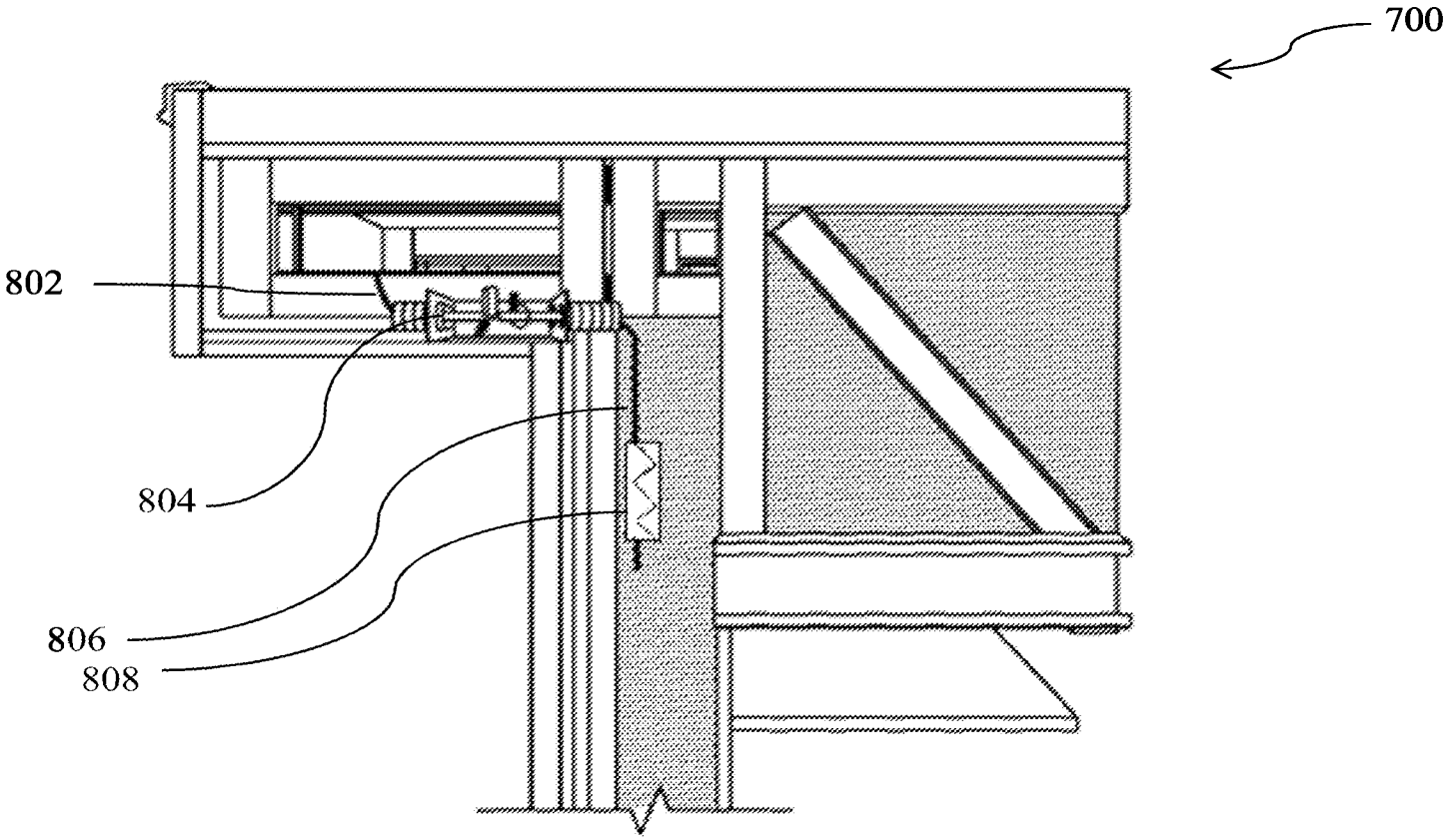
FIG. 8 illustrates a sectional view of the roof panel of FIG. 7 in accordance with an embodiment.

FIG. 8 illustrates a sectional view of the example roof panel in accordance with an embodiment. FIG. 8 will be explained in conjunction with description of FIGS. 1-7.

FIG. 8 illustrates a sectional view of the roof panel 700 to depict electrical-equipment (s) provided as electrical fixtures and electrical components within the roof panel 700. The electrical equipment as included within the roof panel 700 includes a raceaway 802 for housing and routing electrical wires across the roof panel 700. The electrical wires as routed are connected to an electrical box 804, which in an example may be an electrical junction box (4×4) with or without a cover. A metal armored electrical cable 806, which for example corresponds to a Wall Panel Whip, emerges from the electrical box 804 and is thereafter packed/concealed within the mineral wool of the roof panel 700. The metal armored electrical cable 806 upon emerging outside the roof panel 700 is routed to an electrical load 808 or in another example a power source such as an electrical socket. In an example, as later shown in figures, the various roof panels 700 upon having been mechanically connected with each other may also be electrically connected either serially or in parallel as a daisy chain.

It will be apparent to a person with ordinary skill in the art that dimensions and numbers utilized in the view of the roof panel 700 are for illustration purposes only, and such types of roof panels, number of units, and dimensions may vary based on construction site/purpose/budget/requirements, etc.

Figure 9:
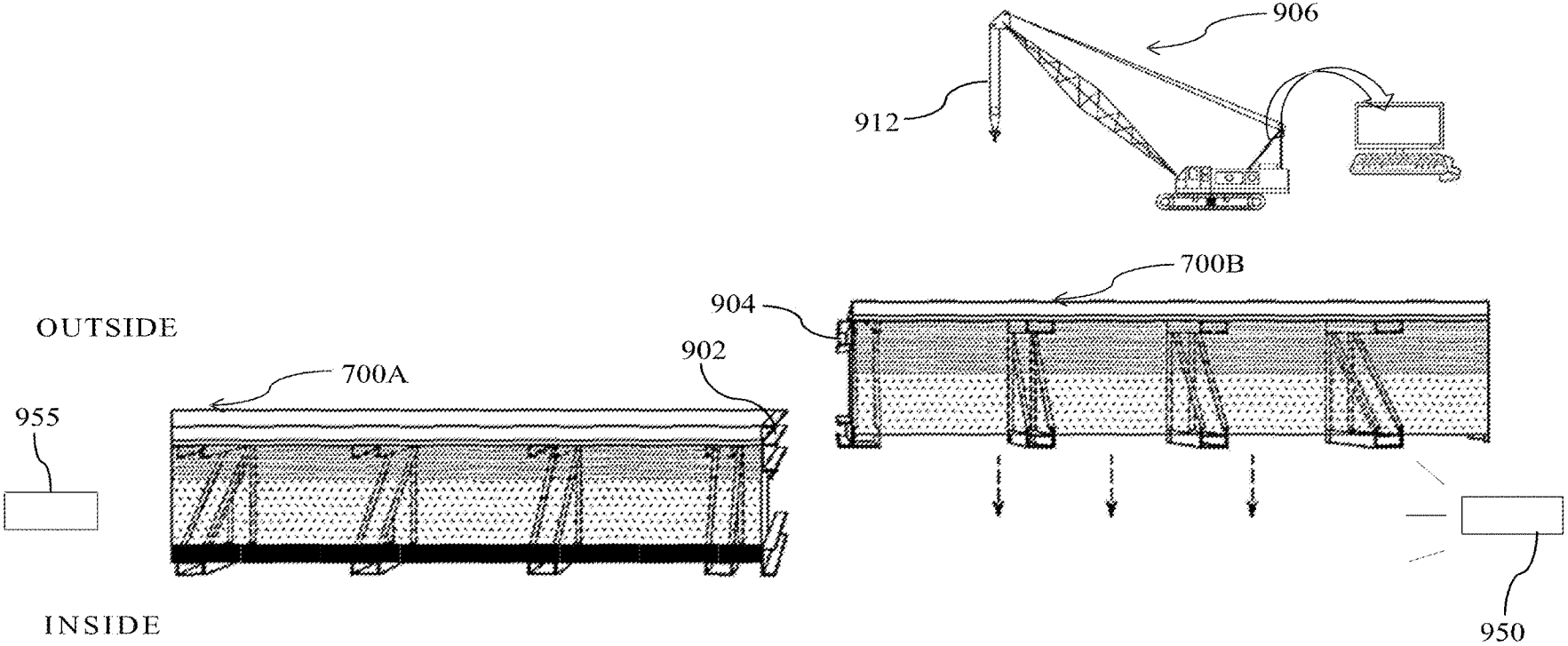
FIG. 9 illustrates an example step of connecting roof panels in accordance with an embodiment.

FIG. 9 illustrates an example step of connecting roof panels in accordance with an embodiment. FIG. 9 will be explained in conjunction with the descriptions of FIGS. 1-8.

FIG. 9 illustrates an example step of mechanically connecting roof panels 700A and 700B (collectively, 700) with each other in accordance with an embodiment. Specifically, FIG. 9 represents an initial step of connecting the roof panels 700A and 700B such that panel 700B may be lowered to be aligned to reach the same elevation as that of panel 700A. In an example, the panel 700B may be hoisted, lifted, positioned through either a mechanical arrangement such as a pulley mechanism or electromechanically through a computer controlled crane 906 or an equivalent hosting-lowering system. In an automated system, the crane 906 and computer are coupled to a camera or other sensor for sensing the location of the walls, roof panels, and track relative to each other. Such lifting/lowering may be automated or semi-automated, performed through a human operator and/or artificial intelligence. Further, the panel 700A and panel 700B are provided with an unlipped stud 902 and a swaged stud 904 on respective vertical faces as proposed to contact each other to enable the mechanical connection between panel 700A and panel 700 B.

With respect to the roof panel 700A, the unlipped stud 902 may be supported along a first vertical edge of roof panel 700A. Accordingly, although not shown in FIG. 9, the swaged stud 904 may be supported within roof panel 700A along a second vertical edge which is opposite the first vertical edge.

Figure 10:
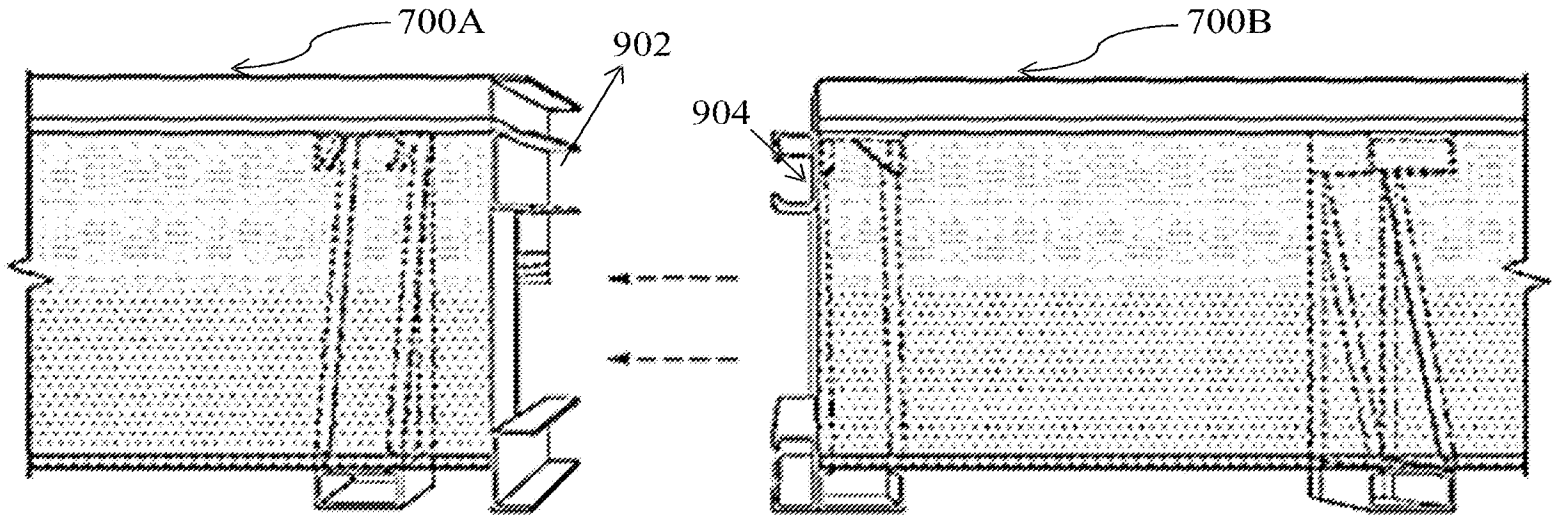
FIGS. 10(*a*), (*b*) and (*c*) illustrate other example steps of connecting roof panels in accordance with an embodiment.
Figure 10:
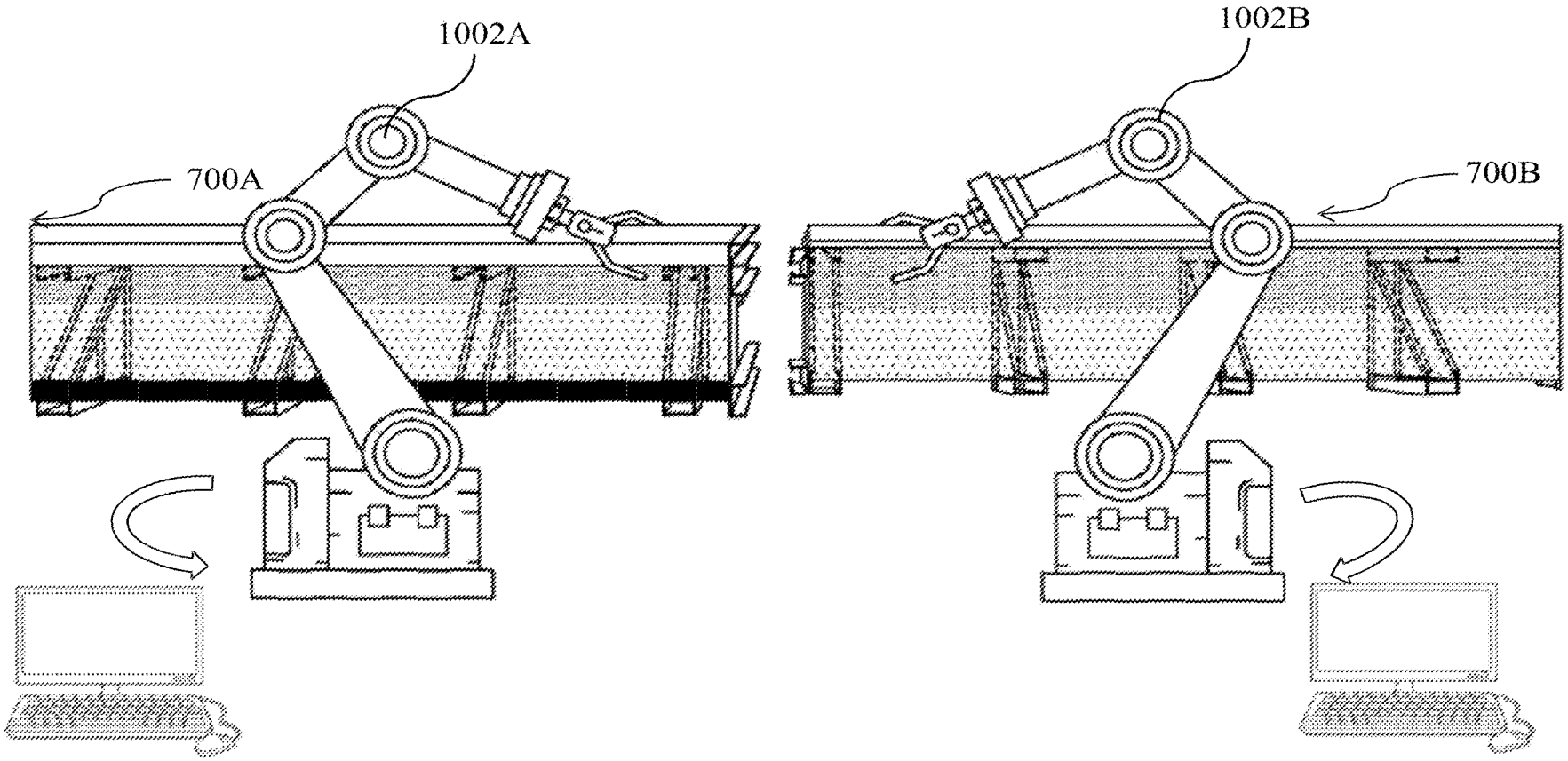
Figure 10:
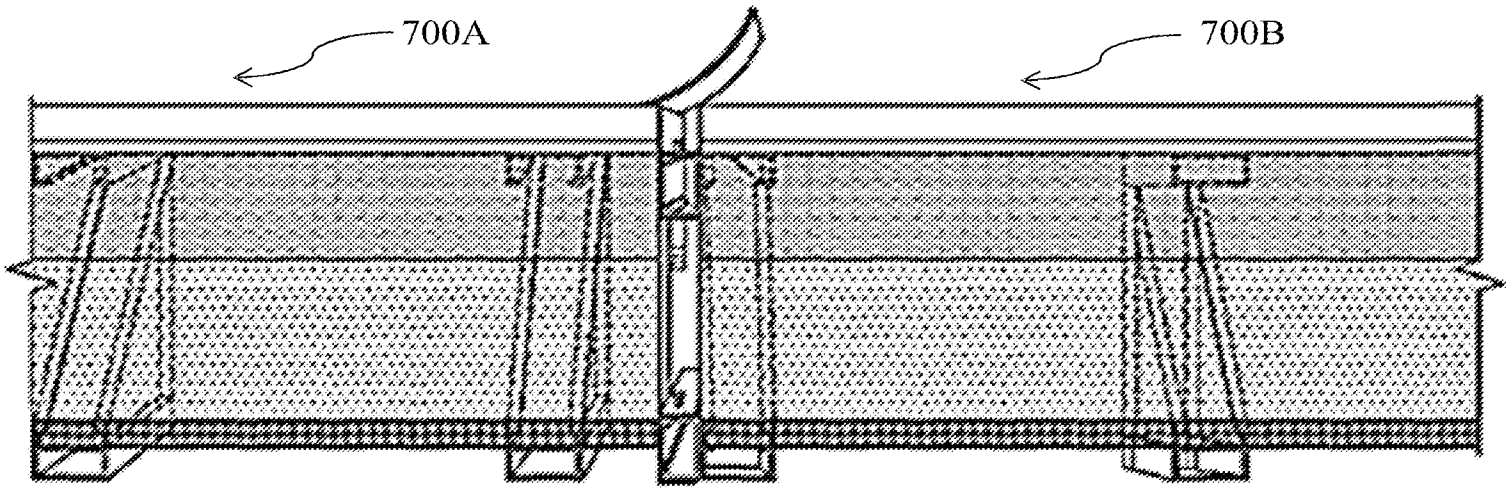

FIGS. 10(*a*), 10(*b*) and 10(*c*) (collectively, FIG. 10) illustrate other example steps of mechanically connecting roof panels 700A and 700B in accordance with an embodiment. FIG. 10 will be explained in conjunction with the description of FIGS. 1-9.

FIG. 10 illustrates example steps of mechanically connecting roof panels 700A and 700B (collectively, 700) with each other in accordance with an embodiment. As may be observed from FIG. 10*a*, the panel 700B is lowered and slid into proximity of panel 700A to enable the mechanical contact between the unlipped stud 902 and the swaged stud 904. As may be observed from FIG. 10*b*, as a part of such lowering-sliding operation, the roof panel 700B may be pushed against a stationary roof panel 700A or both the panels 700A and 700B may be pushed against each other to enable insertion/securing of the swaged stud 904 within the unlipped stud 902. In an example, the force required for such lowering-and-sliding operation is provided through either a mechanical arrangement such as a pulley mechanism or electromechanically through one or more computer controlled robotic arms 1002A and 1002B (collectively, 1002). Such a pushing operation may be automated or semi-automated, performed through a human operator and/or artificial intelligence. Further, as may be observed from FIG. 10*c*, the unlipped stud 902 acts as a receptacle to receive the swaged stud 904 and thereby define a male-female connector pair between panel 700A and panel 700B.

Figure 11:
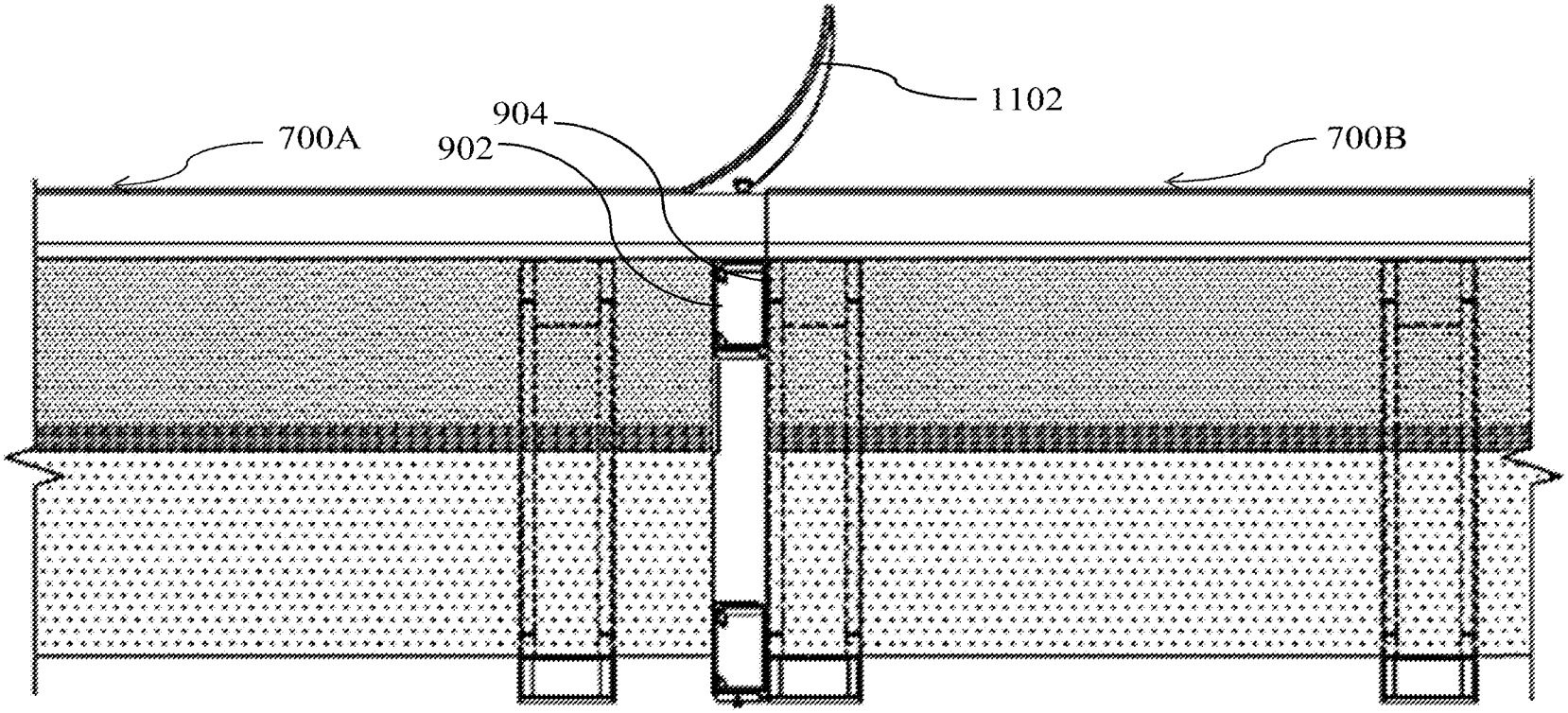
FIG. 11 illustrates yet another example step of connecting roof panels in accordance with an embodiment.

FIG. 11 illustrates yet another example step of connecting the roof panels 700A and 700B in accordance with an embodiment. FIG. 11 will be explained in conjunction with the descriptions of FIGS. 1-10.

FIG. 11 illustrates yet another example step of mechanically connecting roof panels 700A and 700B with each other in accordance with an embodiment. More specifically, FIG. 11 depicts screw fastening the unlipped stud 902 and the swaged stud 904 upon reaching the contacting position or connection as depicted in FIG. 10*b*. For effecting this screw fastening mechanism, a TPO membrane 1102 corresponding to the TPO membrane 702 as depicted in FIG. 7 may be lifted for either one or both the panels 700A and 700B to thereby expose the contacting unlipped stud 902 and the swaged stud 904 and provide an ease of incorporating a screw fastener therebetween. Thereafter, the contacting studs 902, 904 as exposed are screw-fastened with each other. For example, for screw fastening, a through-bore may be created across the studs 902, 904 through an example drill machine-based mechanism to achieve a drilled portal hole. Thereafter, a threaded bolt may be inserted through the through-bore and a threaded nut may be used to lock the threaded bolt and achieve the screw-fastening.

Figure 12:
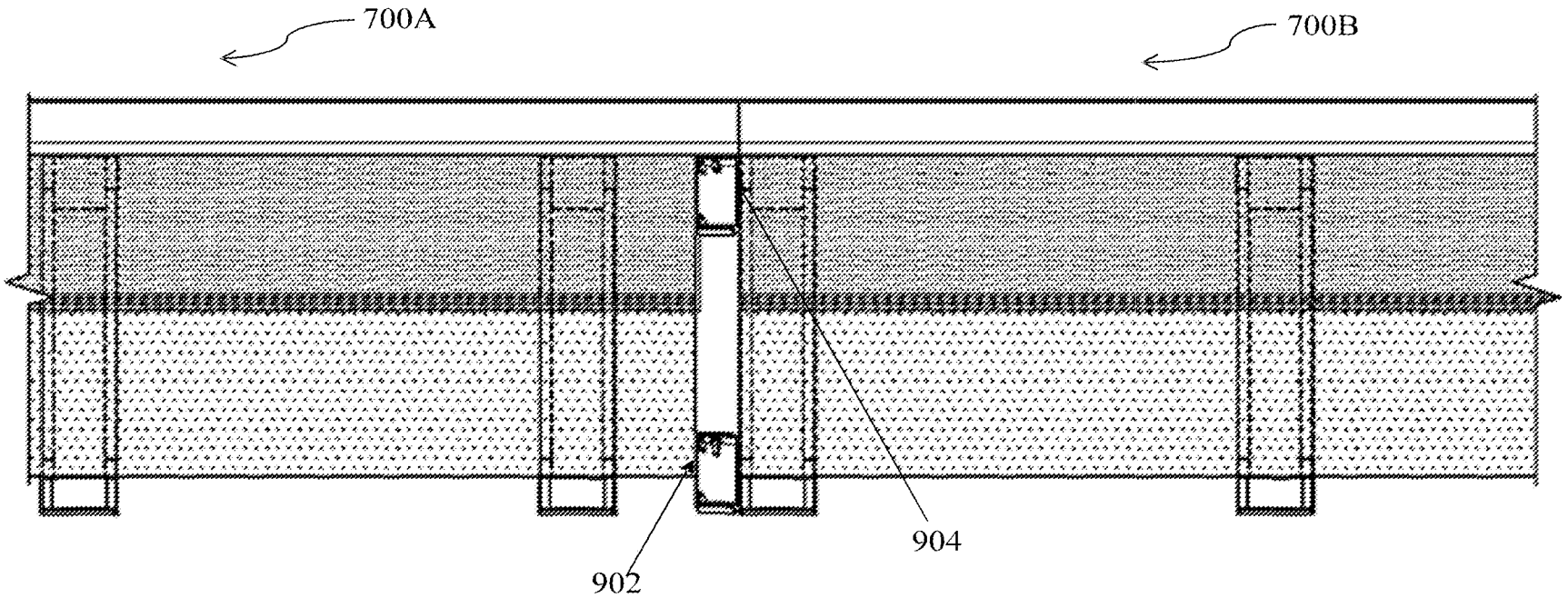
FIG. 12 illustrates yet another example step of connecting roof panels in accordance with an embodiment.

FIG. 12 illustrates yet another example step of connecting roof panels in accordance with an embodiment. FIG. 12 will be explained in conjunction with the descriptions of FIGS. 1-11.

FIG. 12 illustrates yet another example step of mechanically connecting roof panels 700A and 700B with each other in accordance with an embodiment. Specifically, post achievement of screw fastening between the unlipped stud 902 and the swaged stud 904 depicted in FIG. 11, the lifted TPO membranes 702 of either one or both panels 700A and 700B in FIG. 11 are now welded together to achieve seamless connectivity at the top of both panels A and B.

Figure 13:
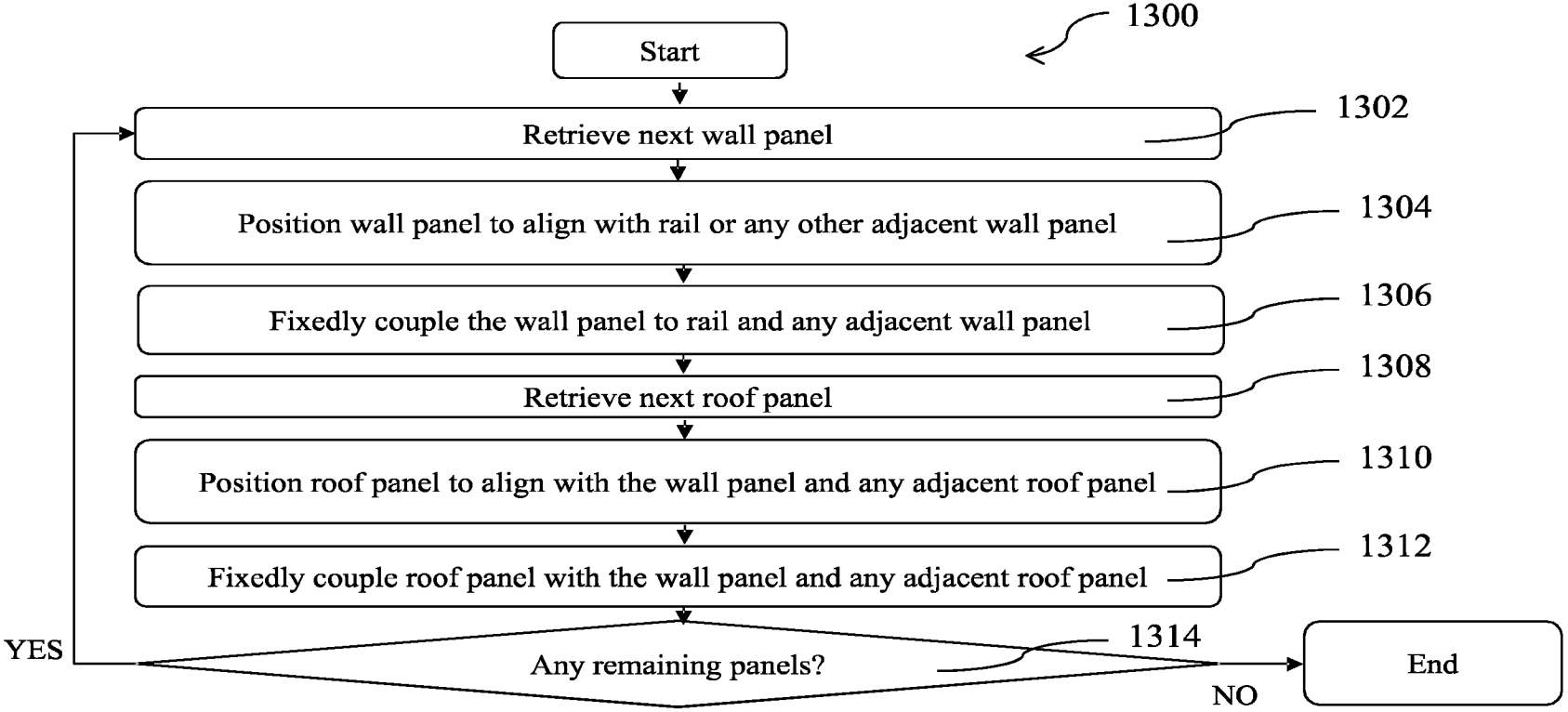
FIG. 13 illustrates method steps of installation of panels in accordance with an embodiment.

FIG. 13 illustrates method steps of installation of panels in accordance with an embodiment. FIG. 13 will be explained in conjunction with the descriptions of FIGS. 1-12.

FIG. 13 illustrates the steps of a method 1300 of installing one or more prefabricated wall panels 102 on a building foundation, i.e., the floor panel 104, followed by installation of the roof panels 700 upon the wall panels 102. Although specific operations are disclosed in FIG. 13, such operations are examples. In different embodiments, to name only a few examples, the method 1300 may include other operations, the sequence of the operations can be modified, some steps may be omitted, or any combination of these variations may be incorporated. The steps of method 1300 may be automated or semi-automated. In various embodiments, one or more of the operations of the method 1300 can be controlled or managed by software, by firmware, by hardware, or by any combination thereof, but is not limited to such.

Method 1300 can include processes of various embodiments of the present disclosure which can be controlled or managed by a processor(s) and electrical components under the control of a computer or computing device comprising computer-readable and executable instructions or code. The readable and executable instructions (or code) may reside, for example, in data storage such as volatile memory, non-volatile memory, and/or mass data storage, as only some examples. As explained later, automation of method 1300 through computer employs various peripherals such as sensors, robotic arms etc. to operate upon panels 102, 104 and 700 during installation.

To generalize the explanation that follows, it is presumed that the first prefabricated wall 102A has already been erected, and the second prefabricated wall 102B is to be erected so that the two are adjacent to each other. However, such generalized description is merely for sake of simplicity of explanation and present subject matter may also be construed to cover simultaneous installation of all panels 102, 104 and 700 without any prior implementation.

It will be appreciated that the steps to erect wall panels 102A are similar to those for wall panel 102B, except that no adjacent wall has yet been installed. In this example, in an initial step, the "next" wall panel is the first wall panel 102A. In this initial step, no "adjacent" wall panel has yet been installed. In the second iteration, described below, the "next" wall panel is the second wall panel 102B, and the "adjacent" wall panel is the wall panel 102A.

At step 1302, a second ("next") wall panel 102B is obtained. The second wall panel 102B may be hooked on a top track 410 along a top horizontal edge of the second wall panel 102B in accordance with the description of FIG. 4.

At step 1304, the second wall panel 102B is positioned to align with the rail 104 and any other adjacent wall panel (here, the first wall panel 102A). More specifically, in step 1302, the hooked wall panel 102B is lowered onto the rail 104 and thereafter released from the hook. For such purposes, the second prefabricated wall panel 102B having a bottom horizontal surface with a second bottom connector 310B (here, the label "B" denoting a component of the second wall panel 102B) is lowered onto the rail 104 coupled to a foundation 204 of a building, the rail 104 having a top horizontal surface with a top connector. The second bottom connector 310B comprises studs and the top connector of the rail 104 comprises recesses or enclosures configured to receive the studs 310B. The second wall panel 102B further comprises a second side surface with a wall connector 502B configured to couple the second wall panel 102B to the first wall panel 102A, the first wall panel 102A comprising a first side surface with a first wall connector matched to the second wall connector. The first wall connector comprises an unlipped stud 502A, and the second wall connector comprises a swaged stud 504B. The second wall panel 102B may also be lowered towards the rail 104, the second wall panel having a second bottom horizontal surface comprising a second bottom connector 310B, until at least a portion of the second bottom connector 310B is inserted into the rail 104. The second wall panel 102B may be moved or pushed so that the second side connector or the swaged stud 504B aligns with the first side connector or the unlipped stud 502A.

At step 1306, the second wall panel 102B is fixedly coupled to the rail 104 and the adjacent wall panel, the first wall panel 102A. The second bottom connector 310B is coupled to the top connector of the rail 104 to secure the second prefabricated wall panel 102B to the rail 104, thereby vertically affixing the second wall panel 102B to the foundation 204. More specifically, the second bottom connector 310B is screw-fastened to the rail 104. Further, the first side connector 502A and the second side connector 504B are also fastened together through screw fastening to achieve coupling there-between.

At step 1308, a roof panel 700B is retrieved.

At step 1310, the roof panel 700B is positioned to align with the wall panels 102A, 102B and any adjacent roof panel, here, first roof panel 700A. More specifically, the roof panel 700B is secured over top horizontal edges 410B of the second wall panel 102B and the first wall panel 102A through a truss. Further, the roof panel 700B maybe sidewise secured to the other (e.g., adjacent) roof panel 700A in accordance with the description of FIG. 9 and FIG. 10.

At step 1312, the roof panel 700B is fixedly coupled with the wall panels 102A, 102B and the adjacent roof panel 700A through screw fastening or welding, to name only a few examples, as explained in the descriptions of FIG. 9 to FIG. 12.

At step 1314, it is checked if there are any further panels pending for installation from amongst the panels 102 and 700. If yes, then a control is transferred back to the step 1302 to undergo further iterations of the method 1300. Otherwise, the method 1300 terminates.

In one aspect, a system for performing the steps 1300 is automated. As one example, referring to FIG. 9, the system comprises (1) a camera arrangement, optical sensor, or other sensor arrangement (e.g., light source 950 and sensor 955) for sensing the relative locations of the components, including the wall panels 102A and 102B, rail 104, and roof panels 700A and 700B, (2) a crane 906 for hoisting, lowering, and adjusting the components relative to each other, (3) an arm (e.g., crane arm 912 or robotic arms 1002A and 1002B, FIG. 10(*b*)) for securing the components to each other, and (3) a computer operatively coupled to the crane 906, the crane arm 912, and the robotic arms 1002A and 1002B, the computer receiving the relative locations and, using the relative locations, the crane, and the arm (crane arm, robotic arm, or both) performing the steps 1300. Preferably, the computer comprises a memory storing computer-executable instructions that when executed perform the steps 1300. In different embodiments, a single robot arm or a pair of robot arms can be used to hoist/lower components, align them, and secure them in place. In some embodiments, any combination of cranes, crane arms, and robot arms may be referred to as a "robot assembly." In one embodiment, the sensor arrangement comprises a light source 950 positioned at the rightmost portion of FIG. 9 and a sensor 955 positioned at the leftmost portion, aligned such as to determine that the wall panels 102A and 102B, roof panels 700A and 700B are aligned. In one embodiment, the light pattern/intensity from the light source 950 impinging on the sensor 955 indicates a degree of alignment between the front surfaces of the panels 120A and 120B.

While FIG. 9 shows a light source 950 and sensor 955 positioned on the right and left portions of FIG. 9 (e.g., on opposite vertical sides of the wall panels so that light is directed at the vertical faces of the wall panels), it will be appreciated that light source-sensor pairs can also be positioned at other locations to determine whether wall panels and roof panels are aligned with each other and the rail. Alternatively, or in addition, a camera capable of determining the depth of objects from the camera and from each other can be positioned to face the front faces, back faces, or both, of the panels to also align components. After reading this disclosure, those skilled in the art will recognize other structures for determining the position and alignment of the wall panels, roof panels, and rails.

In an example, the wall panel 102, the floor panel 104 and the roof panel 700 may be connected together as explained in the preceding figures to achieve a rapid construct cross-section in accordance with an embodiment. The rapid construct cross-section may be an LGS modular construction. A plurality of blocks, such as the rapid construct cross-section may be combined to allow rapid on-site assembly and completion of the house. In an embodiment, the rapid construct cross-section may be used for SFH.

The rapid construct cross-section includes a bottom portion similar to the floor panel 104 discussed previously in FIGS. 1 to 3. The bottom portion of the rapid construct cross-section is attached to the foundation 204. A middle portion of the rapid construct cross section is similar to the wall panel 102 discussed previously in FIG. 1 to FIG. 6. The top portion of the rapid construct cross section is similar to the roof panel 700 and roof panel details illustrated and discussed previously in FIG. 7 to FIG. 12. Therefore, a person with ordinary skill in the art will ascertain that, in accordance with one embodiment, the rapid construct cross section comprises a combination of building blocks such as the floor panel 104, the wall panel 102, and the roof panel 700.

The rapid construct blocks as may be obtained due to their construction technology, are high quality, forming repeatable and scalable SFH products. They form an IECC energy compliant high-performance envelope.

With reference to the building blocks disclosed in FIGS. 1-13, it is to be noted that various joining methodologies and/or technologies may be utilized to join sub-modules/sub-units of individual building blocks or to join one building block with another. For example, joining technologies may be used to build modular building blocks that when assembled make a building envelope/enclosure structurally and environmentally seamless. In another example, interconnection methodologies may be used between foundation and wall; wall and wall; wall and roof truss; and roof truss and roof truss. In yet another example, interconnection methodologies may be used that speed up assembly processes and reduce the need for skilled labor. In yet another example, interconnection technologies may be used that allow a high degree of module completion in the factory. In yet another example, digitization of modular building blocks may enable repeatability with higher quality levels than traditional methodologies.

The terms "comprising," "including," and "having," as used in the specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition, or step being referred to is an optional (not required) feature of the invention. The term "connecting" includes connecting, either directly or indirectly, and "coupling," including through intermediate elements.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures, and techniques other than those specifically described herein can be applied to the practice of the invention as broadly disclosed herein without resort to undue experimentation. All art-known functional equivalents of methods, devices, device elements, materials, procedures, and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation. Additionally, it should be understood that the various embodiments of the building blocks described herein contain optional features that can be individually or together applied to any other embodiment shown or contemplated here to be mixed and matched with the features of that building block.

While the invention has been described with respect to a limited number of embodiments, those skilled in the art, having benefit of this disclosure, will appreciate that other embodiments can be devised which do not depart from the spirit and scope of the invention as disclosed herein.

We claim:

1. A prefabricated roof panel comprising:

a plurality of layers comprising one or more of:

a water proofing membrane, a sheathing board, a plywood layer, and a false ceiling;

a light gauge steel (LGS) structure exhibiting a slope relative to a foundation;

a plurality of metal column studs interspersed in mineral wool above and below the LGS structure;

an access panel adapted to facilitate a coupling of the prefabricated roof panel with a wall panel;

one or more connectors for coupling the prefabricated roof panel to an other roof panel, wherein the one or more connectors comprising:

at least a first vertical stud supported along a first vertical face of the prefabricated roof panel, wherein a male connector of the first vertical stud is configured to couple to a female connector of a second vertical stud of the other roof panel, wherein the second vertical stud supported along a second vertical face opposite to the first vertical face; and a cantilever arrangement.

2. The prefabricated roof panel of claim 1, further comprises a termination flashing for edge waterproofing.

3. The prefabricated roof panel of claim 1, wherein the cantilever arrangement is provided as an overhang to render a balanced mounting of the prefabricated roof panel across the wall panel.

4. The prefabricated roof panel of claim 1, further comprises a raceaway for housing and routing electrical wires across the prefabricated roof panel.

5. The prefabricated roof panel of claim 1, further comprises a first unlipped stud supported along a first vertical edge and a first swaged stud supported along a second vertical edge of the prefabricated roof panel, wherein the first vertical edge is opposite to the second vertical edge, wherein the first unlipped stud of the prefabricated roof panel is adapted to mechanically connect to a second swaged stud of a first adjacent prefabricated roof panel, and wherein the first swaged stud of the prefabricated roof panel is adapted to mechanically connect to a second unlipped stud of a second adjacent prefabricated roof panel.

6. The prefabricated roof panel of claim 5, wherein the first unlipped stud and the first swaged stud of the prefabricated roof panel is mechanically connected to the second swaged stud of the first adjacent prefabricated roof panel and the second unlipped stud of the second adjacent prefabricated roof panel, respectively, via a fastening mechanism.

7. The prefabricated roof panel of claim 5, wherein the first adjacent prefabricated roof panel, the second adjacent prefabricated roof panel, and the prefabricated roof panel mechanically connected with each other are further electrically connected with each other, and wherein the electrical connection corresponds to a serial or a parallel connection.

8. The prefabricated roof panel of claim 5, wherein the mechanical connection of the first adjacent prefabricated roof panel, the second adjacent prefabricated roof panel, and the prefabricated roof panel is achieved using a pulley mechanism.

9. The prefabricated roof panel of claim 5, wherein the mechanical connection of the first adjacent prefabricated roof panel, the second adjacent prefabricated roof panel, and the prefabricated roof panel is achieved electromechanically using a computer-controlled crane communicatively coupled with one or more sensors.

10. The prefabricated roof panel of claim 5, wherein the mechanical connection of the first adjacent prefabricated roof panel, the second adjacent prefabricated roof panel, and the prefabricated roof panel is achieved electromechanically using an automated or semi-automated hosting-lowering system.

11. The prefabricated roof panel of claim 1, wherein the false ceiling at a bottom of the prefabricated roof panel and the access panel adjacent to the false ceiling are adapted to facilitate fastening of trusses of the prefabricated roof panel with the wall panel.

* * * * *